United States Patent [19]

Iwasaka et al.

[11] 3,973,649

[45] Aug. 10, 1976

[54] ELEVATOR CONTROL APPARATUS

[75] Inventors: Tatsuo Iwasaka; Takeo Yuminaka; Takashi Kaneko; Hiroshi Kinoshita, all of Katsuta, Japan

[73] Assignee: Hitachi, Ltd., Japan

[22] Filed: Jan. 27, 1975

[21] Appl. No.: 544,274

[30] Foreign Application Priority Data

| | | |
|---|---|---|
| Jan. 30, 1974 | Japan | 49-11818 |
| Feb. 15, 1974 | Japan | 49-17566 |
| Mar. 25, 1974 | Japan | 49-32578 |

[52] U.S. Cl. ..... 187/29 R

[51] Int. Cl.[2] ..... B66B 1/18

[58] Field of Search ..... 187/29

[56] References Cited

UNITED STATES PATENTS

| | | | |
|---|---|---|---|
| 3,511,342 | 5/1970 | Hall et al. | 187/29 |
| 3,739,880 | 6/1973 | Robaszkiewicz | 187/29 |
| 3,746,131 | 7/1973 | Hirasawa et al. | 187/29 |

*Primary Examiner*—Robert K. Schaefer
*Assistant Examiner*—W. E. Duncanson, Jr.
*Attorney, Agent, or Firm*—Craig & Antonelli

[57] ABSTRACT

An elevator control apparatus is provided with means for detecting a new type of elevator car traffic information consisting of the information indicating, by allotting the passengers in the car to resistered cage calls, how many passengers classified for each of destination floors are in the car, namely, the information indicating the number of in-cage passengers classified for each of destination floors. In an apparatus comprising means for allotting a hall call generated to an optimum one of a plurality of cars and means for detecting the number of prospective passengers waiting on the floors, the number of prospective passengers waiting at the floor the hall call from which is allotted to the car and the number of passengers classified for each of destination floors are added to or subtracted from the number of passengers in the car for each floor involved thereby to forecast the number of in-cage passengers in the leading floors. It is decided whether there is room available or not in the car for accomodating additional passengers at the leading floors, by comparing the forecast number of passengers in the car with a predetermined number limit of the passengers for the car. By the use of the result of this decision, the hall call is prevented from being allotted to a car having no room for accomodating additional passengers.

17 Claims, 27 Drawing Figures

FIG. 1

| | 10F | 9F | 8F | 7F | 6F | 5F | 4F | 3F | 2F | 1F |
|---|---|---|---|---|---|---|---|---|---|---|
| (1) CAR POSITION | | | | | | | | | ↑ | |
| (2) CAGE CALLS | | ○ | | | ○ | | | | | |
| (3) NUMBER OF IN-CAGE PASSENGERS | | | | | | | | | 7 | |
| (4) NUMBERS OF PASSENGERS BY DESTINATION FLOORS | | 4 | | | 3 | | | | | |
| (5) HALL CALLS | | | | △ | | | △ | | | |
| (6) HALL WAITING PASSENGERS | | | | 4 | | | 2 | | | |
| (7) FORECAST NUMBERS OF PASSENGERS BY DISTINATION FLOORS | | 10-4=6 | 10 | 6+4=10 | 9-3=6 | 9 | 7+2=9 | 7 | | |

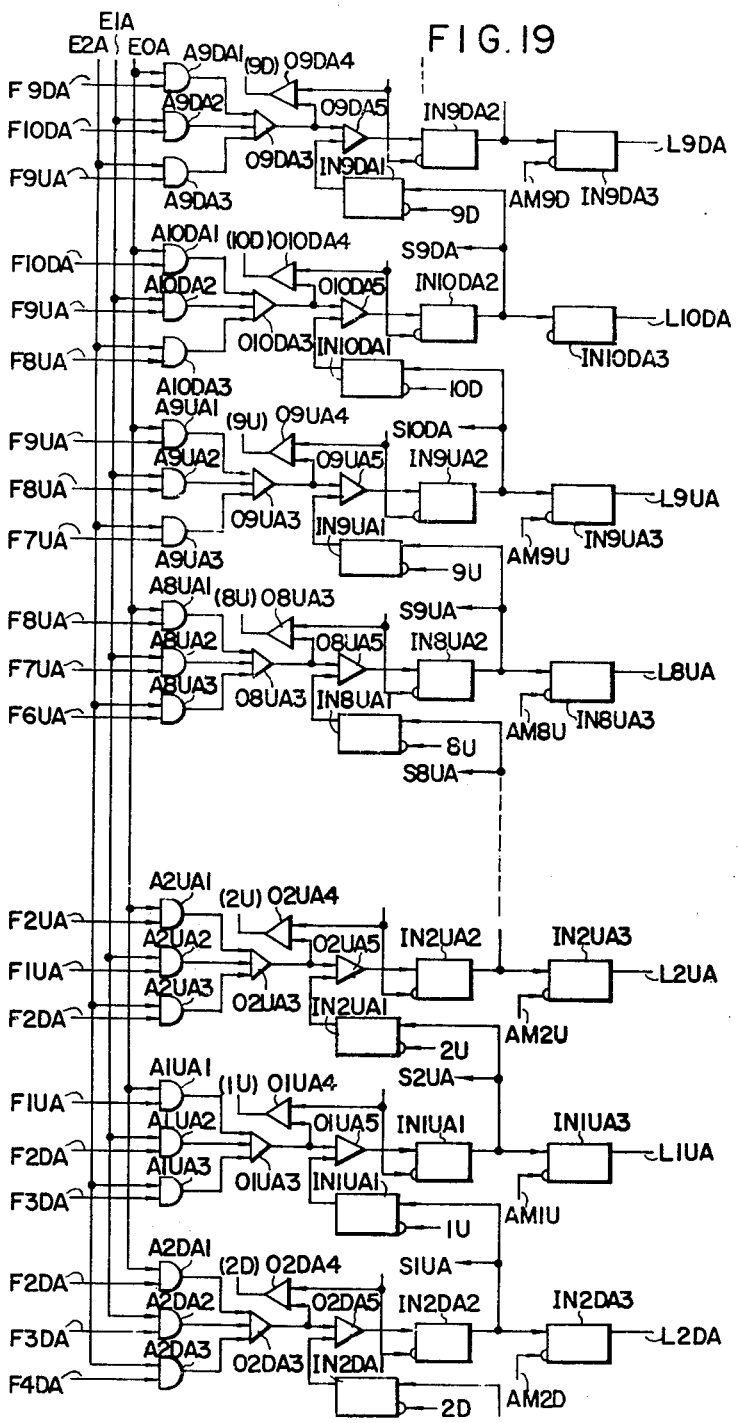
FIG. 19
E1A
E2A
E0A
F9DA
F10DA
F9UA
A9DA1
(9D) O9DA4
A9DA2
O9DA5
IN9DA2
L9DA
O9DA3
IN9DA1
A9DA3
9D
AM9D
IN9DA3
A10DA1
(10D) O10DA4
S9DA
F10DA
A10DA2
O10DA5
IN10DA2
F9UA
L10DA
O10DA3
IN10DA1
F8UA
IN10DA3
A10DA3
10D
A9UA1
(9U) O9UA4
S10DA
F9UA
A9UA2
O9UA5
IN9UA2
F8UA
L9UA
O9UA3
IN9UA1
F7UA
IN9UA3
A9UA3
AM9U
9U
A8UA1
(8U) O8UA3
S9UA
F8UA
A8UA2
O8UA5
IN8UA2
F7UA
L8UA
A8UA3
O8UA3
IN8UA1
F6UA
IN8UA3
AM8U
8U
S8UA
A2UA1
(2U) O2UA4
F2UA
A2UA2
O2UA5
IN2UA2
IN2UA3
F1UA
L2UA
A2UA3
O2UA3
IN2UA1
F2DA
AM2U
2U
A1UA1
(1U) O1UA4
S2UA
F1UA
A1UA2
O1UA5
IN1UA1
IN1UA3
F2DA
L1UA
A1UA3
O1UA3
IN1UA1
F3DA
AM1U
1U
A2DA1
(2D) O2DA4
S1UA
F2DA
A2DA2
O2DA5
IN2DA2
IN2DA3
F3DA
L2DA
A2DA3
O2DA3
IN2DA1
F4DA
AM2D
2D

ELEVATOR CONTROL APPARATUS

The present invention relates to an elevator control apparatus or more in particular to an apparatus for controlling elevator cars by detecting the number of in-cage passengers classified for each of destination floors.

With the recent trend toward higher building, it is strongly required to improve the transport capacity of elevator cars which play a vital role as a vertical transportation facility. To achieve this purpose, elevator cars are being increased in speed on the one hand while an increasing number of the elevator cars are used in juxtaposition in a building on the other. Further, the demand is high for higher performance of the elevator control system in order to attain a high efficiency of the elevator cars, a great carrying capacity as well as an improved car service.

The methods for achieving a high performance of the elevator cars include detecting the traffic demand for elevator cars thereby to operate the elevator cars according to the changing situation of passengers, to control the elevator cars in such a manner as to equalize the spatial intervals between the travelling cars in order to shorten the elevator car waiting time of the prospective passengers as a whole, or to relate the operation of a plurality of cars to each other.

If a high performance is to be achieved for elevator control as mentioned above, it is necessary to detect a multiplicity of elevator car traffic information and use it as a control element.

Such traffic information includes, for example, the position of each car, the intervals between different cars, the number or calls to be served by the respective cars and the like. By utilizing these types of traffic information, the car intervals are controlled as an example as mentioned above, so as to equalize the number of calls to be served by each car as well as to equalize and shorten the waiting time of prospective passengers on the halls. Further to the above-mentioned traffic information, a day may be divided into several time zones including the morning rush hours when most of the passengers go up from the dispatch floor, the evening rush hours when most of the passengers go down and the lunch recess when the destinations of most cars are the floor where restaurants are located. These time zones are detected appropriately thereby to detect the traffic demand, according to which the elevator cars are controlled. By utilizing the above-described types of traffic information as elements for controlling the elevator cars, it is possible to perform highly reliable and accurate elevator control meeting the prevailing situation.

Generally, it is important to increase the number of the types of traffic information obtainable and to improve the quality of such information for the purpose of attaining a high performance of elevator operation.

In the recently-employed group control system relating the operation of a plurality of cars to each other, prospective passengers waiting on the halls are informed that a certain car is scheduled to serve them, immediately after or after a certain delay time of the generation of a hall call. This method is watched as a superior system whereby the prospective passengers waiting on the halls are able to spend their time without any hesitation on the landing of a specified car, among many cars in juxtaposition, which is expected to serve them.

There are two methods as described below for early indicating and guiding the prospective passengers to the car scheduled to serve them.

One of such methods for indication and guiding is to set the service zone of each car in accordance with the ever-changing relation between the positions of the respective cars in such a way that up and down calls from all the floors may be covered by combining the service zones of all the cars. By so doing, a car to serve a given hall call is decided immediately on the basis of the set service zones, whenever such a call is generated.

The other method is to determine a car most suitable to serve a hall call, at the time point when such a hall call is generated. A signal representing what might be called a suitability is produced for each car from a multiplicity of information, so that an elevator car highest in suitability is selected. This process of selection may be finished instantaneously by scanning the respective cars.

The car thus determined to serve and indicated on the landing where the prospective passengers are waiting must not be changed. If a car other than indicated arrives earlier to serve the passengers, it will develop their disbelief, thus making useless the guiding and indication system.

As a measure to prevent such an error, a method is considered in which the guiding and indication is done only after the car to serve the waiting passengers is determined. This method reduces the risk of the erroneous indication attributable to the outrunning of one car by another but is not effective in the case where a travelling car is filled to capacity before arriving at the calling floor. In other words, even if it is decided that, say, car A will obviously be able to serve a hall call before the other cars at the time point when it is issued, its first arriving at the particular floor will be of no use if it is filled up with passengers earlier.

On the other hand, an attempt was made to determine a car to serve a hall call, on the basis of the number of in-cage passengers. Such an attempt, however, has failed since it was impossible to know the number of in-cage passengers which is reached at the next moment.

This failure is due to the fact that the number of passengers in a car could not be forecast appropriately. The in-cage traffic information so far available is limited to the destination floors known by the cage call registration means and the current number of in-cage passengers detected by car load detector means.

Accordingly, it is an object of the present invention to provide means for detecting new elevator traffic information representing how many passengers classified for each of the destination floors are in a cage, namely, the number of in-cage passengers classified for each of destination floors (which is hereinafter called such as the numbers of in-cage passengers for destination floors), thus enabling a high-performance elevator control taking into consideration the numbers of passengers for destination floors for an improved service of elevator cars.

A second object of the invention is to provide means for forecasting the number of in-cage passengers at a given destination floor by taking into consideration the number of passengers getting on and off earlier, thereby making possible an elevator car control on the basis of forecasting of the number of passengers at the destination floor.

A third object of the invention is to provide means for deciding whether or not a car is able to serve an advance floor thereby to prevent any prospective passenger waiting on the advance floor from being left unloaded in the car.

A fourth object of the invention is to provide means for allotting hall calls taking into consideration the forecast numbers of passengers at the destination floors and thus to enable proper allotment of hall calls based on the forecasting of the future number of passengers for improved control of elevator cars.

A feature of the present invention lies in that the number of passengers in a car and the cage calls registered are detected so that the numbers of passengers for destination floors are detected by allotting at a set ratio the detected number of passengers to each of the floors associated with the cage calls. Further, in order to improve the accuracy with which the numbers of in-cage passengers for destination floors are detected as above, the ratio of allotment is adjusted according to the prevailing traffic demand and the numbers of in-cage passengers for destination floors are corrected in accordance with variations in the cage calls or the number of passengers.

A second feature of the invention lies in that the numbers of prospective passengers waiting on the halls who are to get on the car by the service of the car are detected so that the numbers of in-cage passengers at advance floors are detected by adding to or subtracting from the passengers in the car the detected numbers of in-cage passengers for destination floors and the detected prospective passengers for every corresponding advance floor thereby to forecast the number of in-cage passengers at the particular advance floors.

A third feature of the invention is to set a limit on the number of prospective passengers which the car can additionally accommodate and thus to decide whether or not the car is able to serve a given advance floor by comparing the set number limit with the forecast number of prospective passengers waiting at the particular advance floor.

A fourth feature of the invention lies in that a hall call generated from a floor is alloted to a car which arrives first at the floor and which, it has been decided, will be able to serve the floor generating the hall call or, in the case where it has been decided that the first-arriving car is unable to serve that floor, to another car which, it has been decided, is able to serve it.

According to the present invention, there is provided an elevator control apparatus whereby a plurality of elevator cars serve a plurality of floors in accordance with the hall calls and cage calls registered in hall call registration means provided on the respective floors and cage call registration means provided in the respective cars, respectively; the apparatus comprising means for detecting the numbers of passengers in the cars for destination floors, the number-of-passengers-for destination-floor detector means including means for detecting the number of passengers in the cars, means for setting the ratio at which the number of passengers in the cars is allotted to the floors associated with the registered cage calls, and means for allotting at the set allotment ratio the number of passengers in the car to each of the floors associated with the cage calls.

The above and other objects, features and advantages will be made apparent by the detailed description taken in conjunction with the accompanying drawings, in which:

FIG. 1 is a diagram for explaining the new traffic information according to the present invention;

Figure 8:
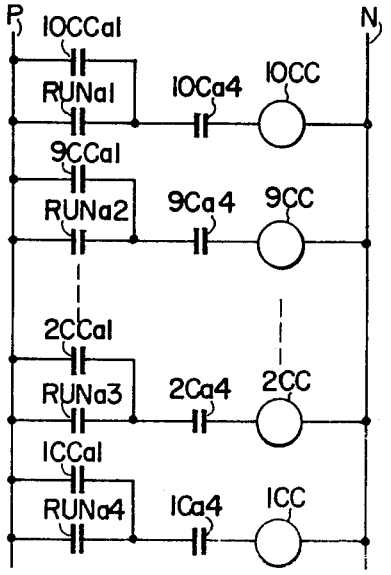
Figure 9:
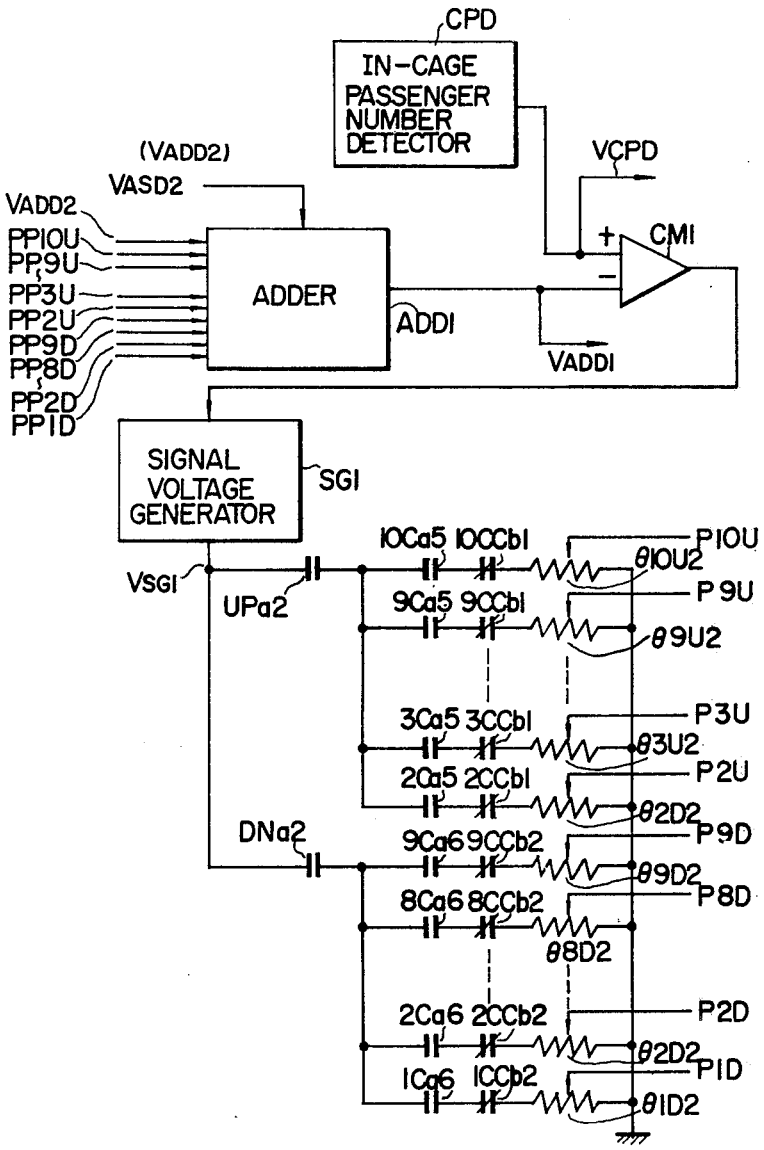
Figure 10:
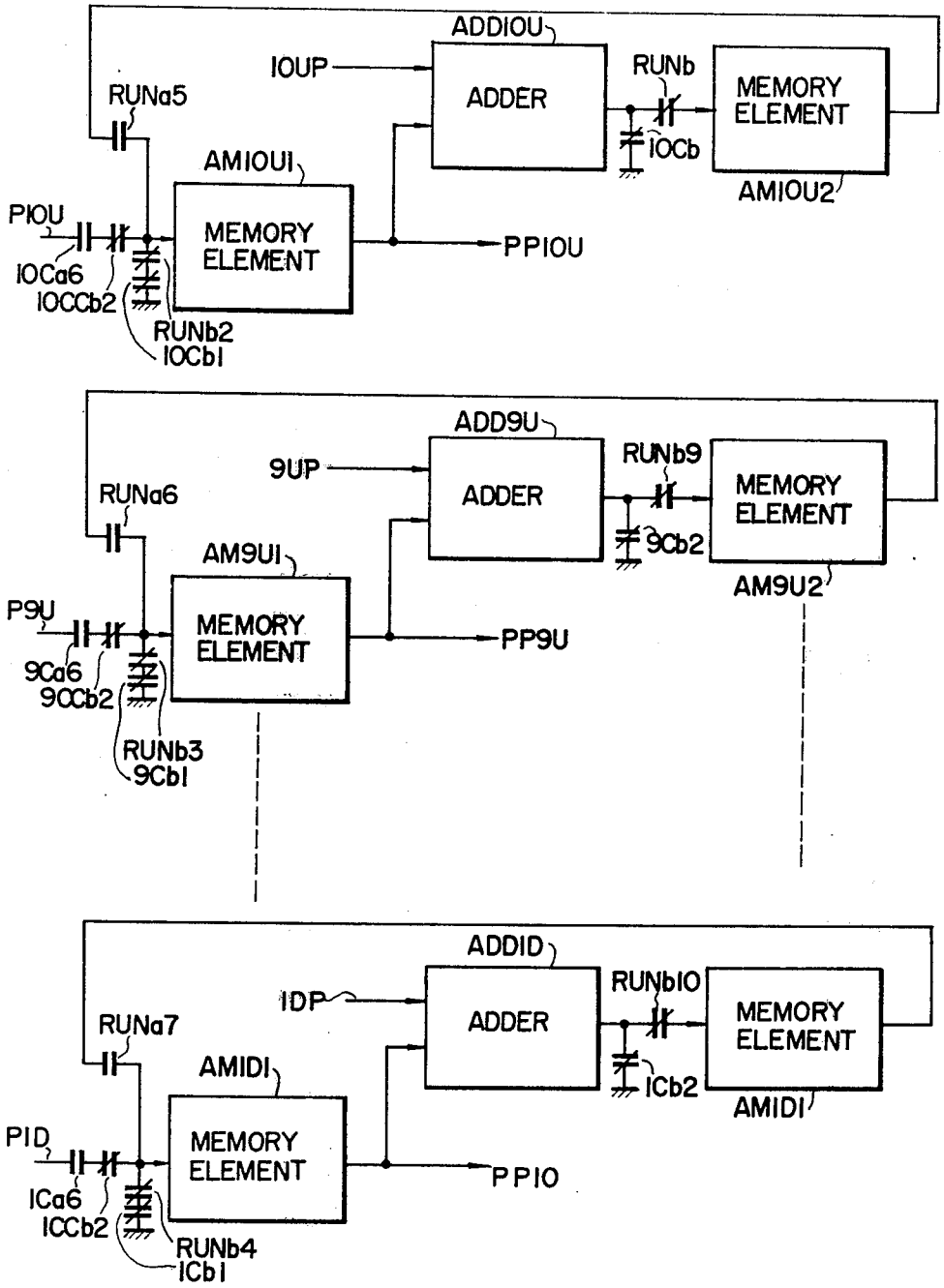
Figure 11:
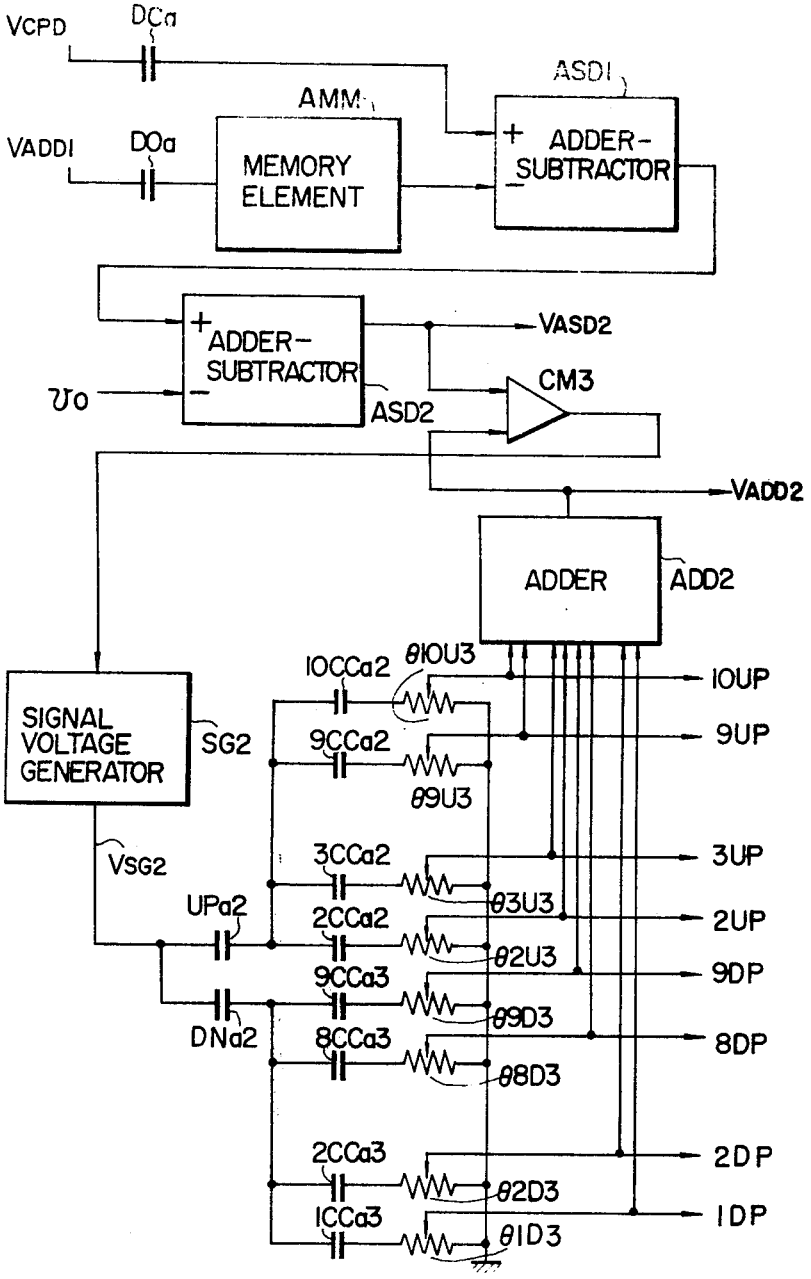
Figure 12:
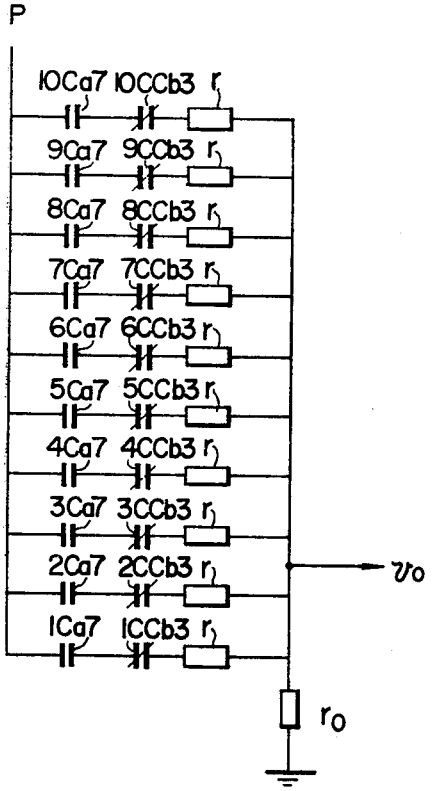
Figure 13:
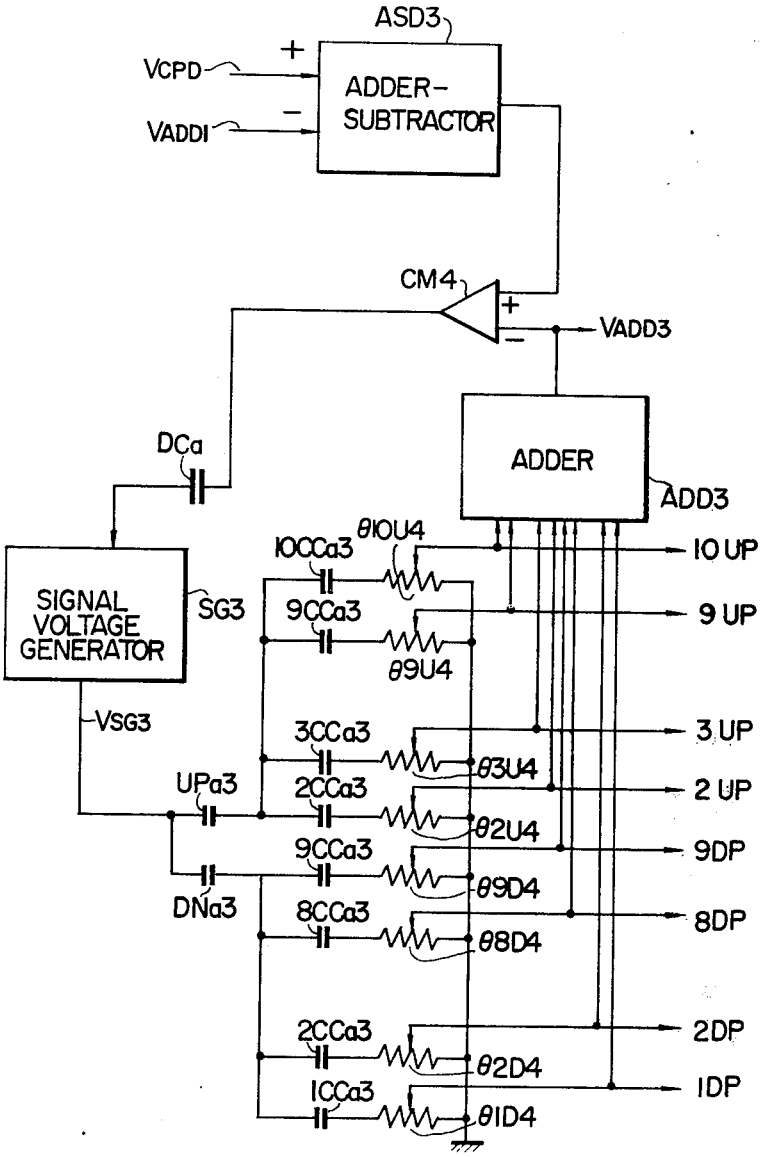
Figure 14:
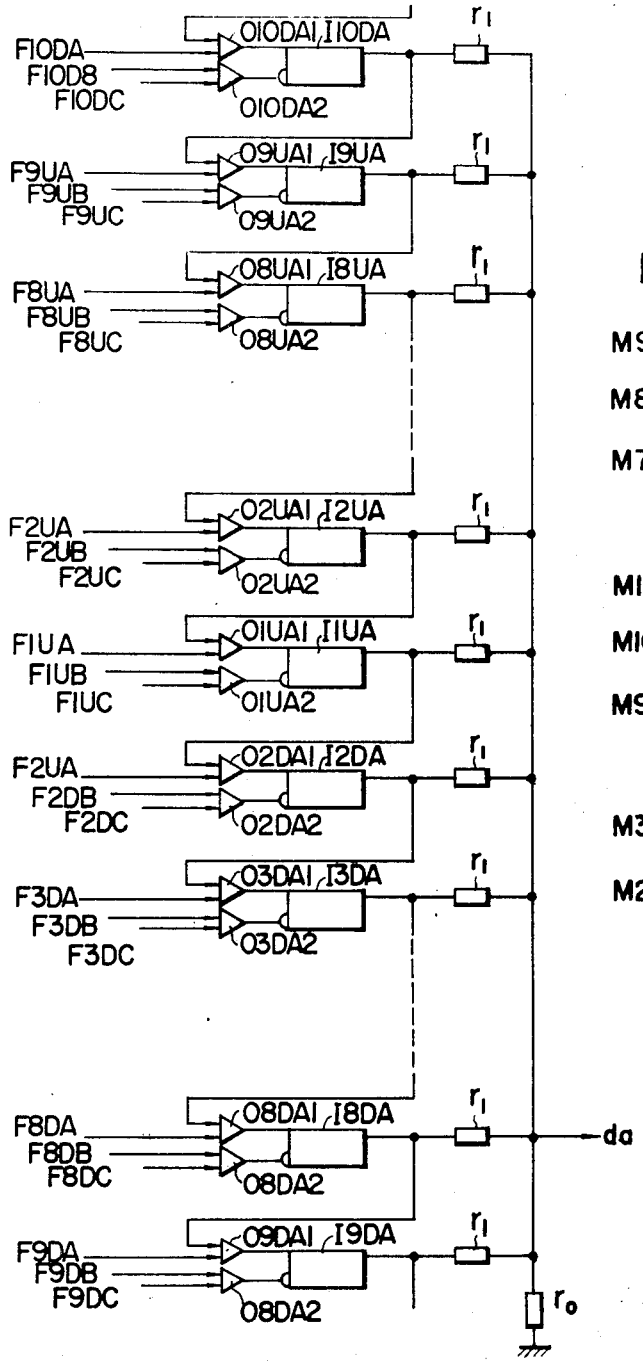
Figure 15:
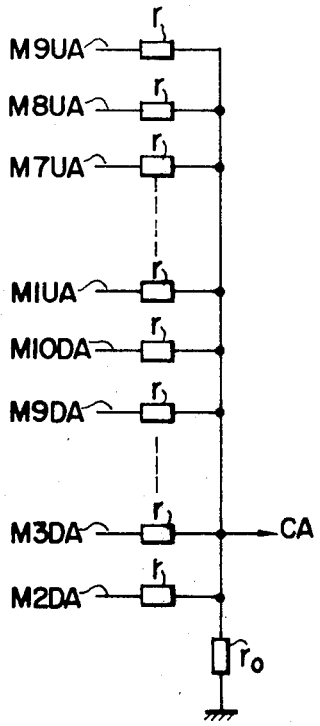
Figure 16:
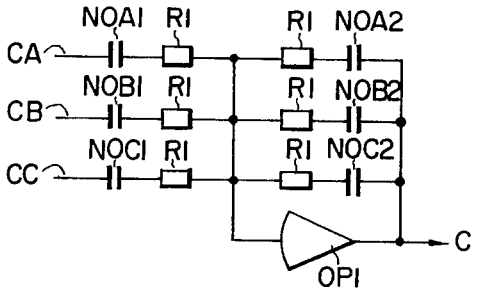
Figure 17:
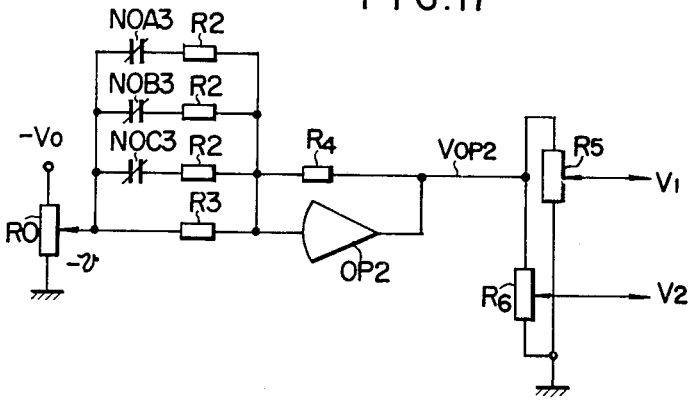
Figure 18:
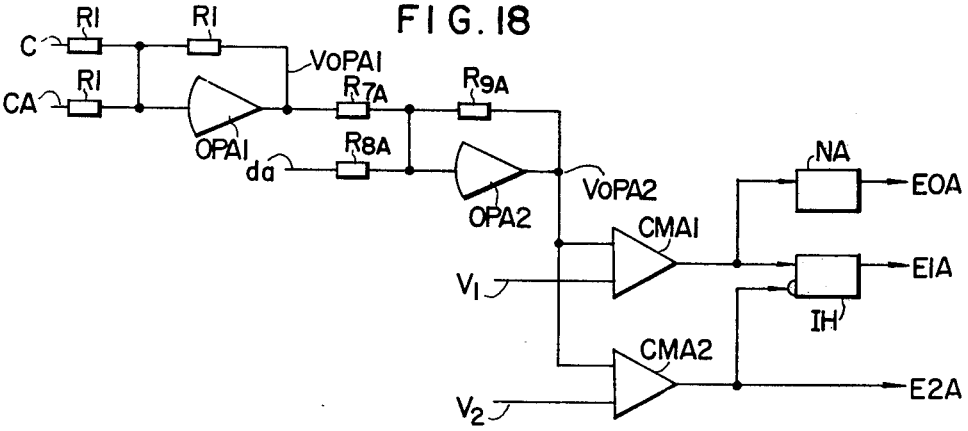
Figure 20:
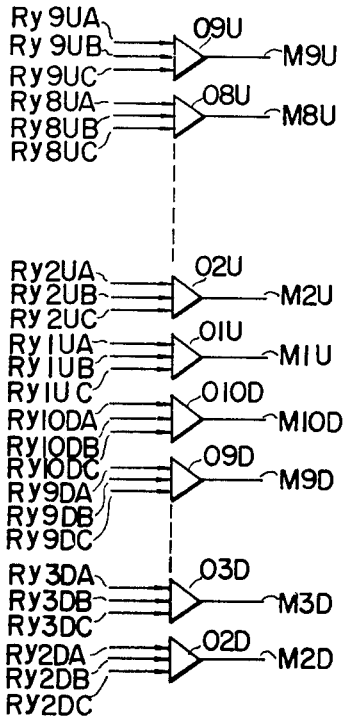
Figure 21:
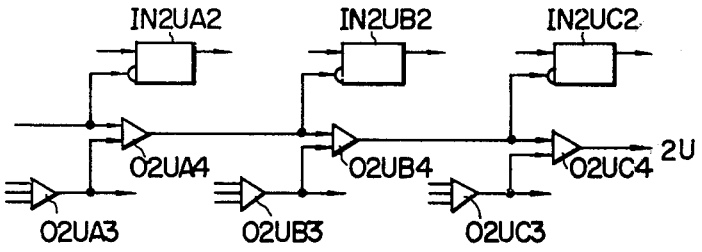
Figure 22:
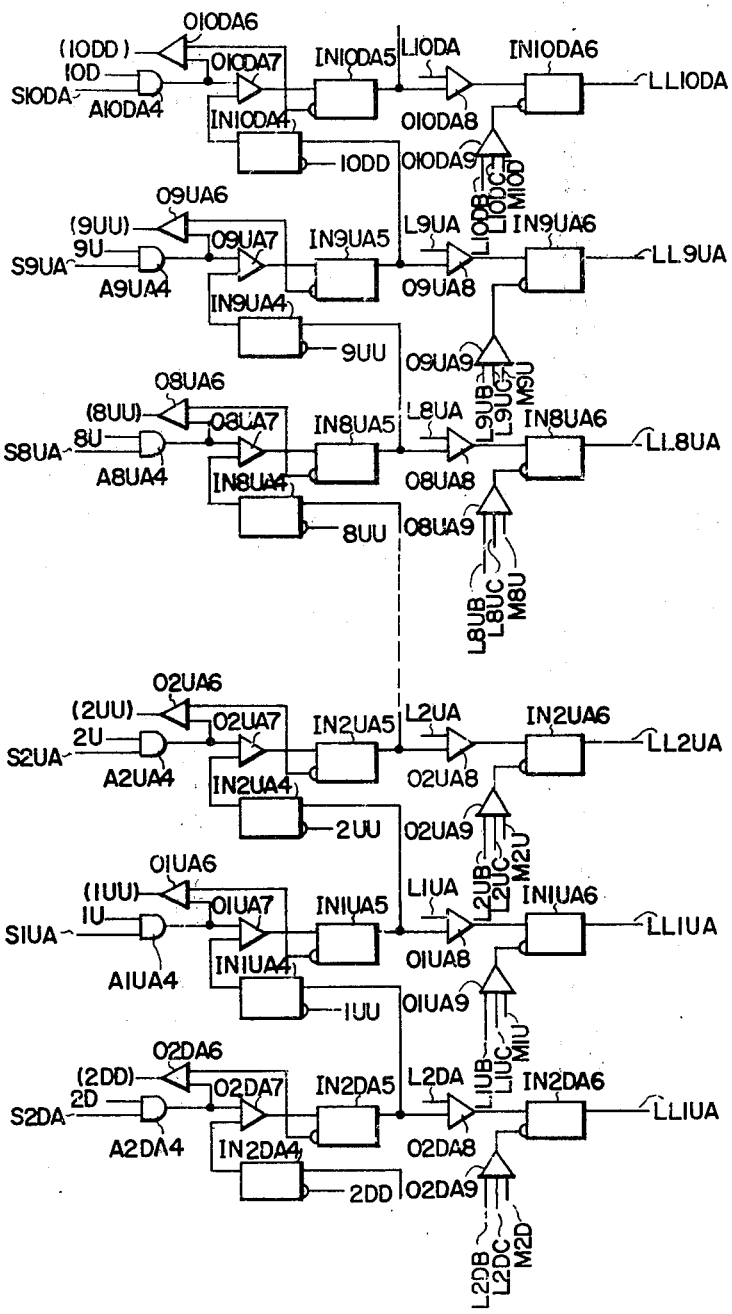
Figure 23:
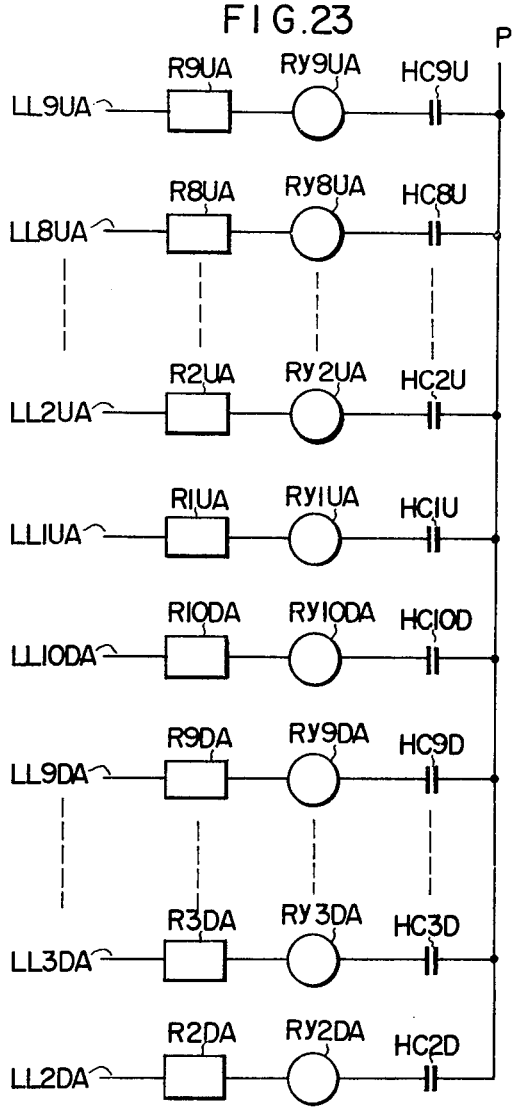
Figure 24:
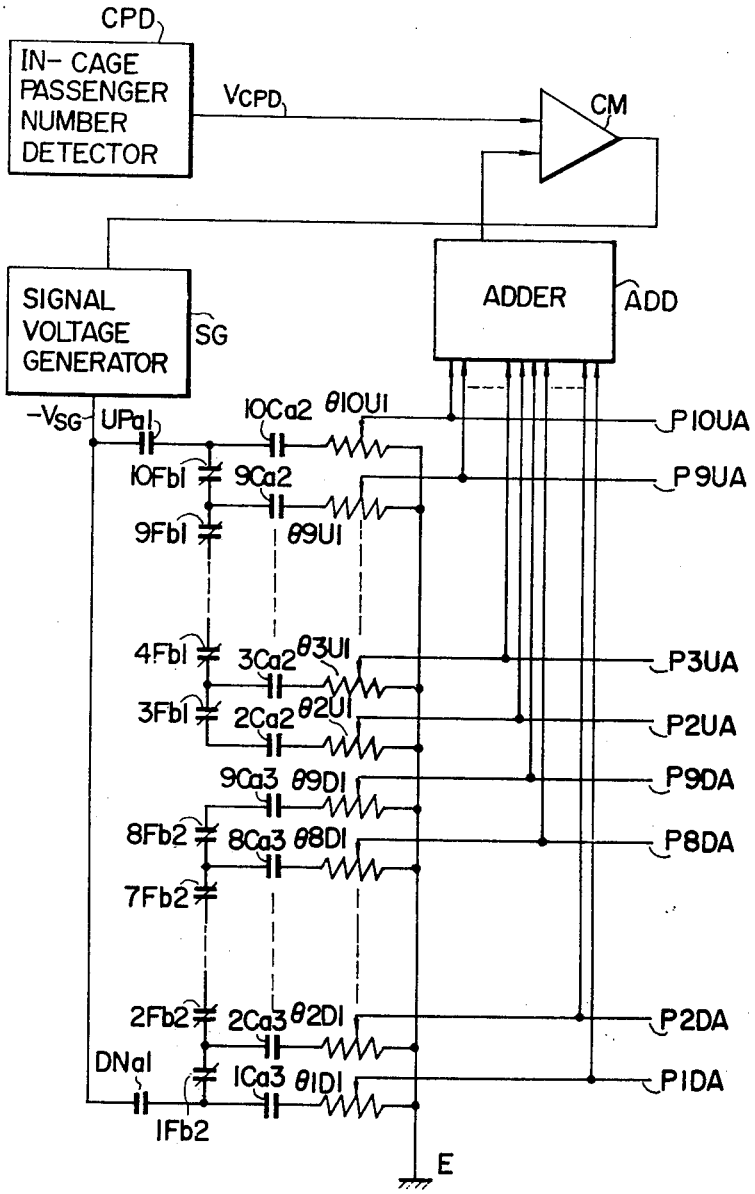
Figure 25:
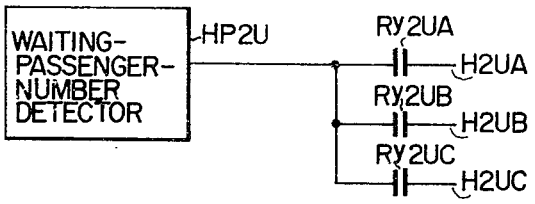
Figure 26:
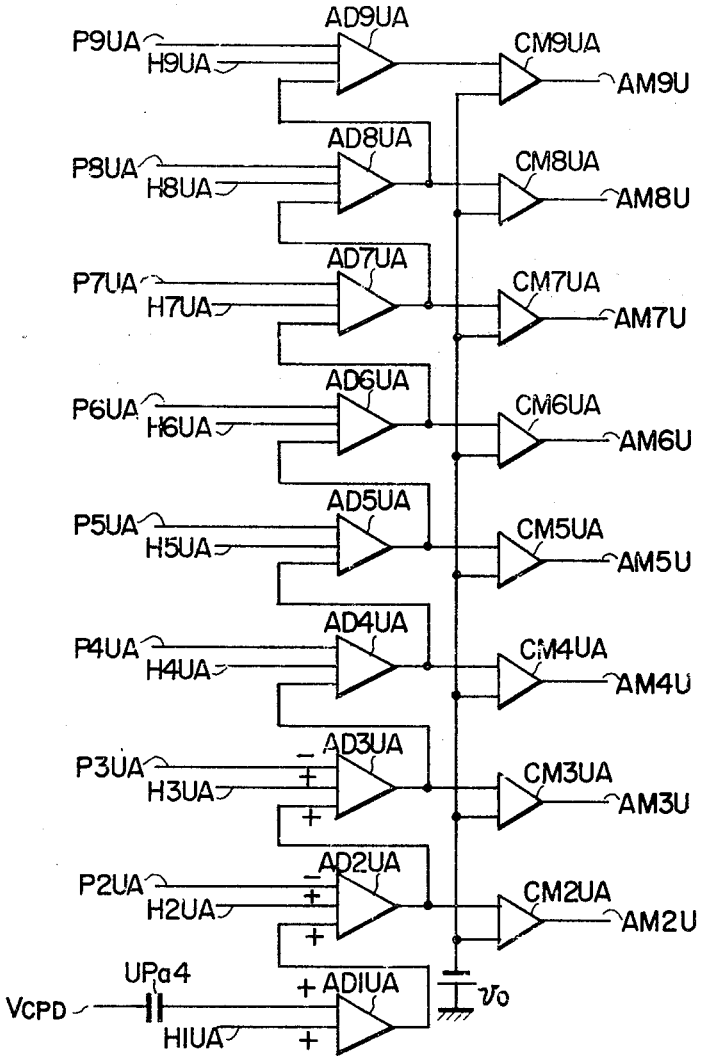
Figure 27:
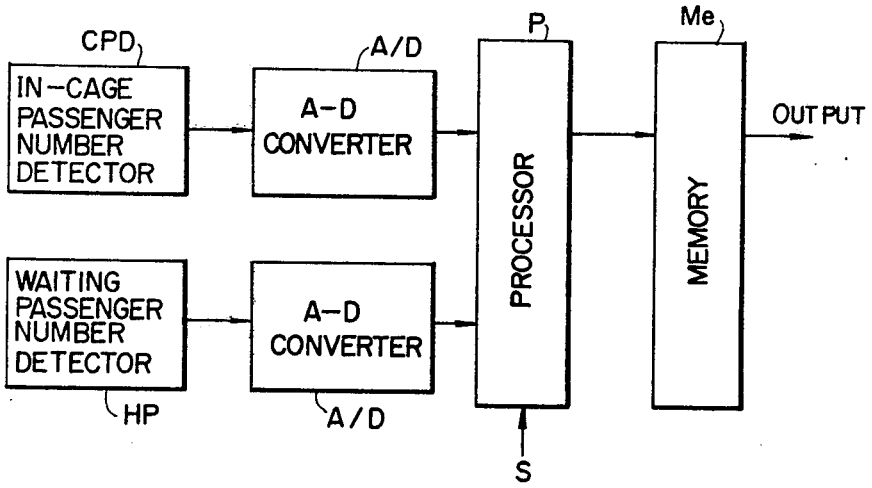

FIG. 8 showing a circuit, required for each car, to detect that a car has begun to travel after the registration of a cage call;

FIG. 9 showing a circuit, required for each car, to detect the numbers of passengers for destination floors associated with newly registered cage calls;

FIG. 10 showing a circuit, required for each car, to store in memory the detected numbers of passengers for destination floors;

FIG. 11 showing a circuit, required for each car, to correct the stored numbers of passengers for destination floors; and FIG. 12 showing a circuit, required for each car, to detect the number of cage calls newly registered;

FIG. 13 is a diagram showing a circuit, required for each car, to correct the numbers of passengers for destination floors according to another embodiment of the present invention;

FIG. 14 to FIG. 26 are diagrams showing a circuit of the elevator control apparatus according to an embodiment of the invention in the case where the new traffic information according to the invention is used for the conventional hall call allotment control utilizing the concept of service zones; including FIG. 14 showing a circuit for detecting the spatial interval between car A and an immediately succeeding car, a like circuit being required for each car;

FIG. 15 showing a circuit for detecting the number of calls to be served by car A, a like circuit being required for each car;

FIG. 16 showing a circuit for calculating the average number of calls to be served by each car;

FIG. 17 showing a circuit for generating a reference voltage for the circuit of FIG. 18;

FIG. 18 showing a circuit for determining the time interval from car A, a like circuit being required for each car;

FIG. 19 showing a circuit for setting the provisional service zone of car A, a like circuit being required for each car;

FIG. 20 showing an interlock circuit for preventing a call already allotted to a car from being allotted to another car;

FIG. 21 showing a circuit for determining the order of priority in which a hall call is allotted, a like circuit being required for each floor concerned;

FIG. 22 showing a circuit for setting a corrected service zone for car A, a like circuit being required for each car;

FIG. 23 showing a circuit for determining the service zone of car A and allotting a hall call generated to car A, a like circuit being required for each car;

FIG. 24 showing a circuit for detecting the numbers of passengers of car A for destination floors, a like circuit being required for each car;

FIG. 25 showing a circuit for distributing the output representing the detection of the number of prospective passengers waiting on the floors, a like circuit being required for each floor concerned; and FIG. 26 showing a circuit for forecasting the number of passengers of car A at the leading floors and for deciding the serviceability thereof, a like circuit being required for each car; and FIG. 27 is a block diagram showing the serviceability decision circuit constructed of a digital circuit according to the present invention.

Prior to describing embodiments of the invention, it will be explained briefly with reference to simple diagrams of FIG. 1 and FIG. 2 to facilitate the understanding of the operating principle of the present invention.

It is assumed here that there are three cars A to C provided in juxtaposition for serving a building having 10 floors from the 1st to 10th floors and that car A is in the state as shown in FIG. 1. In other words, 1. Car A is located at the second floor for up travel (actually, a position slightly lower than the second floor where it is able to serve an up call from the second floor);
2. Cage calls for the 6th and 9th floors are registered in car A;
3. There are seven passengers in car A.

Under this condition, the present invention provides the numbers of passengers in car A for destination floors as additional traffic information. As mentioned, the apparatus according to the invention comprises means for setting the ratio at which the number of in-cage passengers is allotted to registered cage calls and means for allotting the number of passengers at the set ratio. In the situation under consideration, there are seven passengers and cage calls are generated for the 6th and 9th floors, so that the number of passengers in car A by destination floors is determined as three for the 6th floor and four for the 9th floor. The accuracy with which the numbers of passengers for destination floors thus determined depends on the ratio for allotting the registered numbers of passengers to the cage calls. In an ordinary building, however, passengers of cars behave in a somewhat fixed pattern specific to the particular building. This pattern may depend on the traffic demand prevailing on each occasion. During the lunch time, for instance, most of the passengers will go to the floor where a restaurant or cafeteria is located. Such a situation is met by adjusting the above-mentioned allotment ratio whereby it is possible to greatly improve the accuracy of detection of the numbers of passengers for destination floors. In another case where there are offices related to each other at the 2nd and the 5th floors, many of the passengers taking the car at the 2nd floor will go to the 5th floor, and vice versa, resulting in the allotment ratio being required to be adjusted accordingly, as will be explained more in detail afterwards.

The present invention further provides an elevator control apparatus utilizing additional traffic information based on the numbers of passengers for destination floors detected as above.

Assume that the elevator control apparatus according to the invention is provided with a conventional device for allotting hall calls to cars and a recently developed device for detecting the number of prospective passengers waiting on the halls. It is accordingly assumed that 5. Up hall calls from the 4th and 7th floors are allotted to car A;
6. There are two and four prospective passengers waiting on the 4th and 7th floors respectively.

According to the apparatus of the present invention, the numbers of passengers at the advance floor for car A are forecast on the basis of the above-mentioned numbers of passengers for destination floors and the data (5) and (6) above. More specifically, in view of the fact that three and four persons will get off at the 6th and 9th floors respectively and that two and four persons will get on at the 4th and 7th floors respectively, the numbers of passengers of car A for destination floors are predicted to be 7, 9, 9, 6, 10, 10 and 6 for the 3rd to the 9th floors respectively.

The numbers of passengers thus forecast are compared with the passenger number limit of car A to decide whether or not car A is able to serve a given floor. In the event that the number of passengers of car A is limited to 10, for example, it will be seen that any up hall call which may be generated at the 8th floor should not be served. Such a call from the 8th floor, therefore, will be taken care of by another car, preferably by an immediately succeeding car. In other words, it is decided that car A is capable of serving up hall calls generated at the 2nd to 7th floors and the 9th floor, while it cannot take care of any hall call issued from the 8th floor.

By using the traffic information thus detected as an element for elevator control, it is possible to perform a highly accurate control of an elevator system.

Next, the elevator control apparatus according to the present invention utilizing the above-mentioned additional traffic information will be briefly explained. The explanation will be made with reference to the case in which a service zone defining a range for serving hall calls for each car is set and hall calls are allotted to the cars according to such service zones.

Figure 2:
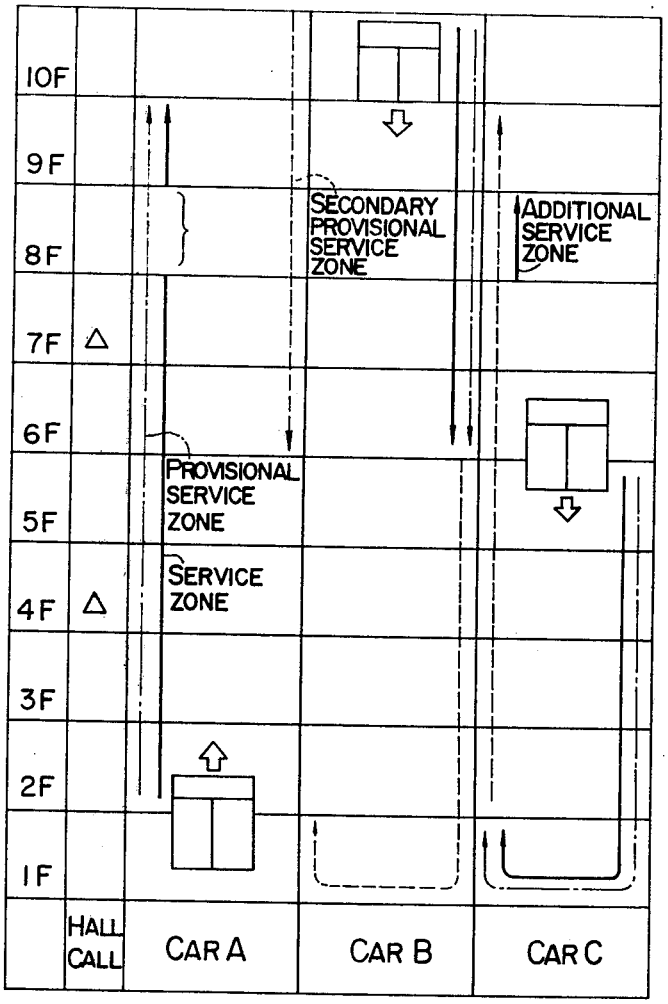
FIG. 2 is a diagram for explaining the outline of the control operation of the elevator control apparatus according to the present invention.

The provisional service zones for three cars including car A, car B and car C are described in FIG. 2. It is assumed in the drawing that car A is at the 2nd floor for up travel, car B at the 10th floor for down travel and car C at the 5th floor for down travel (actually at a point a little higher than the level of the 5th floor, as mentioned already with reference to car A). In this case, it is most suitable to define the service zone of each car as a range from its own position to an immediately leading car. Such a service zone is shown by a one-dot chain arrow for each car, so that hall calls generated within the service zones indicated by arrows are allotted to and served by the cars concerned. It will be needless to say that these service zones undergo continuous changes with the movement of the respective cars.

It was already assumed that it is decided that car A is unable to serve an up hall call from the 8th floor. It is necessary therefore to eliminate the up travel for the 8th floor from the above-defined provisional service zone of car A, thus determining the service zone of car A to include the 2nd to 7th floors and the 9th floor for up travel. As a result, in addition to the up hall calls from the 4th and 7th floors, car A will serve any hall calls which may be generated for up travel from the 2nd, 3rd, 5th, 6th or 9th floor. Each time a hall call is generated, however, it is decided whether or not hall call which might be generated subsequently can be served, in the manner already mentioned, taking into consideration the hall calls previously decided to be served and the related number of hall-waiting passengers. The resulting actual service zones are indicated by solid-line arrows.

In this way, the apparatus according to the invention is provided with a service zone setting device for determining an actual service zone of a car comprising floors which are included in the provisional service zone and at the same time which are determined to be serviceable by the particular car on the basis of the relation between the forecast number of in-cage passengers and the number limit of passengers.

In such a construction, it is possible to effect proper allotment of hall calls by restricting the hall call allotment which results in the number limit being exceeded or causes an improper number of passengers to be present in the car under the prevailing condition of traffic demand.

On the other hand, a hall call such as the up hall call from the 8th floor which has been removed from the actual service zone of car A must be allotted to any other car. For this purpose, what might be called a secondary provisional service zone is determined for each car. In FIG. 2 is shown the operating sequence of the cars which is car A to car C to car B to car A. Car C is immediately following car A, car B following car C, and car A following car B. The provisional service zones of the respective cars are determined to be the secondary provisional service zones of the cars immediately following them respectively, as illustrated in dashed-line arrows in FIG. 2. A hall call which does not belong to the actual service zone of any car such as the 8th floor up hall call is allotted to one of the cars according to the secondary provisional service zones. In the cited case, an up hall call generated from the 8th floor belongs to the secondary provisional service zone of car C and therefore will be served by car C.

Figure 3:
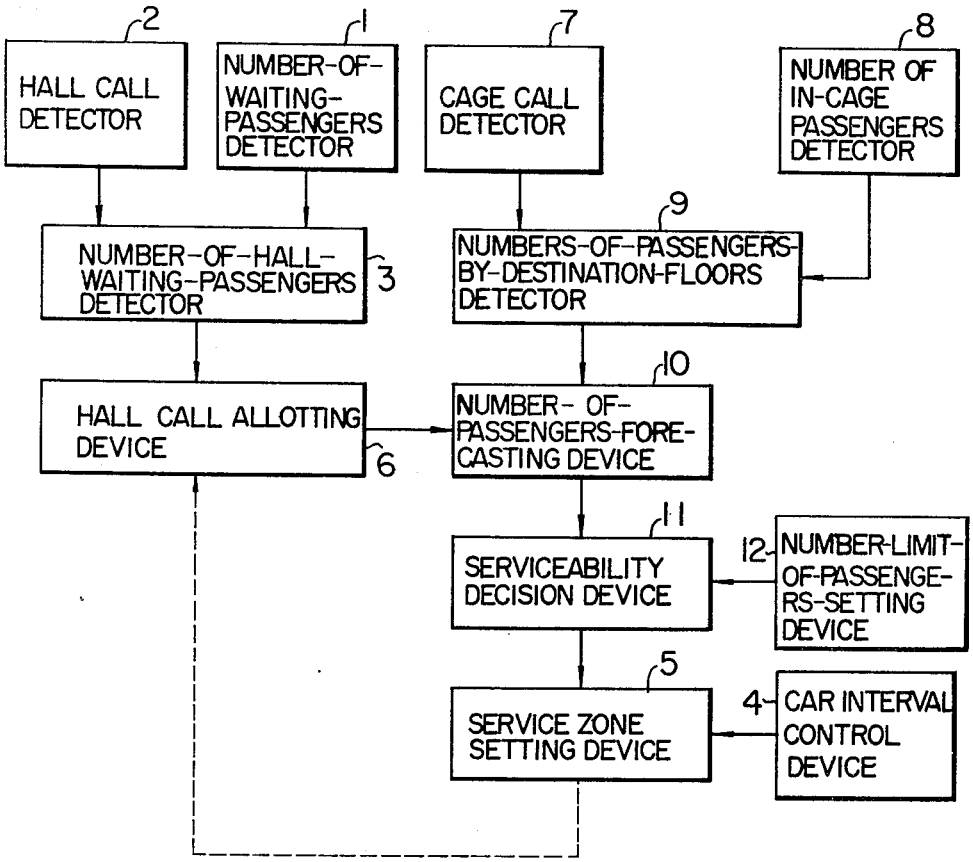
FIG. 3 is a block diagram showing the elevator control apparatus according to an embodiment of the invention.

Apart from the brief description made of the operation of the apparatus according to the invention, the whole construction thereof will be briefly explained below with reference to a block diagram of FIG. 3 showing an embodiment of the invention.

Reference numeral 1 shows the number-of-waiting-passengers detector 1 provided on the landing of each floor which, as has so far been developed, includes the following:

1. The device operating on mat switches;
   A multiplicity of mat switches are arranged on as many units of floor space each measuring, say, 60 cm by 40 cm, required for each prospective passenger on the landing of each floor, so that the number of the prospective passengers waiting on the floor landing is detected by the number of such mat switches energized;
2. The device operating on ultrasonic wave;
   A multiplicity of ultrasonic wave receivers are mounted on the ceiling or side walls of each landing, so that the presence or absence of persons on or in the vicinity of the landing is detected by the travel time of reflected wave thereby to know the number of hall-waiting passengers;
3. The device using an industrial television camera (ITV);
   An ITV is arranged directed toward each landing whereby the number of hall-waiting passengers is determined by detecting the presence or absence of persons on the basis of the state of the output or variations of the picture elements of the camera.

Reference numeral 2 shows a hall call detector for picking up any unit of the number-of-waiting-passengers detector 1 associated with a floor where a hall call is generated, and numeral 3 a device for detecting the number of hall waiting passengers to determine the number of prospective passengers waiting at the floor where the hall call has been generated.

On the other hand, each of a multiplicity of juxtaposed elevator cars is provided with an interval control device 4 for distributing the cars uniformly among the floors to be served, and the provisional service zone for each car is determined by the service-zone-setting device 5 in response to a signal issued from the interval control device 4 and a signal from the serviceability decision device 11. Numeral 6 shows a device for allotting hall calls, which, in response to the output from the service zone setting device 5, allots a hall call to a car with a provisional service zone covering such a hall call when it is generated.

Also, a cage call generated in a car is detected by a cage call detector 7. Numeral 8 shows a device for detecting the number of passengers in a car comprising a well known weighing device. Numeral 9 shows a device for detecting the numbers of passengers for destination floors which produces an output signal representing the numbers of passengers for destination floors by allotting the number of passengers to the cage calls. Reference numeral 10 shows a device for forecasting the number of passengers which will be present at the respective advance floors on the basis of the above-mentioned numbers of passengers for destination floors, the number of prospective passengers waiting on the floor generating the already-allotted hall calls, the number of in-cage passengers and the number of passengers waiting on the floor generating the hall call which has been provisionally allotted according to the provisional service zone thereof. The serviceability decision device 11 is for deciding whether or not a car is able to serve a given floor by comparing the forecast number of passengers as above with the number limit of passengers set in the device 12.

Thus, in response to the hall call generated, it is decided whether or not the car is able to serve it, and if the hall call is serviceable by the car, that hall call is formally allotted to the particular car. As to any other hall call which is generated subsequently, the car proceeds with similar decision processes while having already taken charge of the above-mentioned first-generated hall call. At the same time, that part of the provisional service zone including the floors involving more than the number limit is eliminated.

An embodiment of the present invention, which has been described briefly above with reference to a block diagram, will be explained more in detail with reference to the accompanying drawings.

Figure 4:
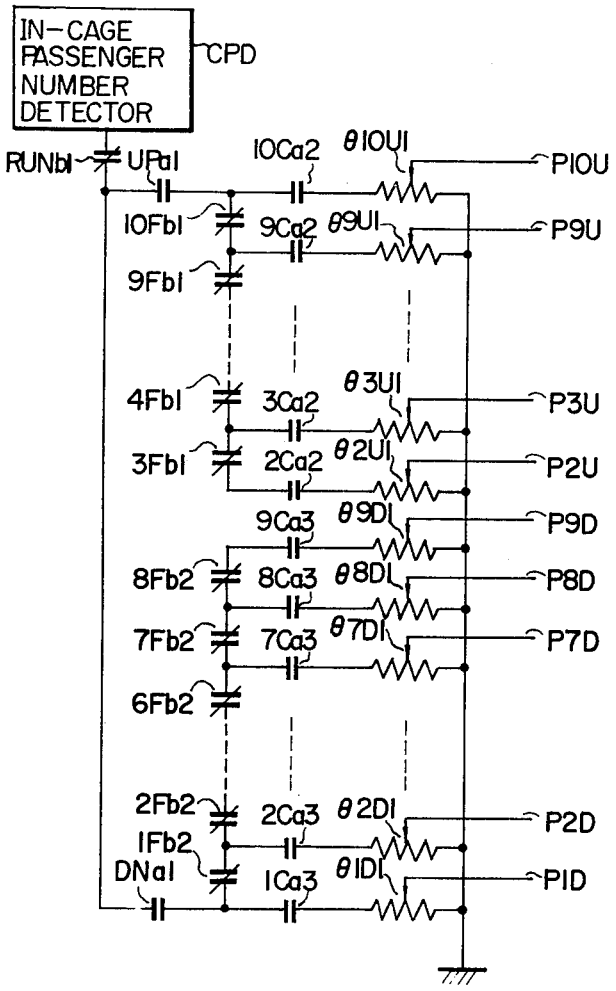
FIG. 4 shows the means for detecting the numbers of passengers for destination floors according to an embodiment of the invention, which is required for each car.

A circuit of the number-of-passengers-for-destination-floor detector embodying the present invention is shown in FIG. 4 showing the case in which the present invention is applied to cars serving 10 floors.

In the drawing under consideration, reference symbol CPD shows an in-cage passenger number detector for generating an electrical signal proportional to the number of passengers in a car, 01D1 to 09D1 and 02U1 to 010U1 variable resistors for setting the ratio at which the number of passengers in the car is distributed among or allotted to the destination floors, symbol RUNbl is a *b* contact of a relay turned on during the travelling of the car, UPal and DNal *a* contacts of relays energized when the car is travelling up and down respectively, 1Fbl to 10Fb2 *b* contacts of relays energized when the car is located at the first to 10th floors respectively, and 1Ca2 to 10Ca3 *a* contacts of relays energized when the first to 10th floors called from inside the cage are registered respectively.

In the above-described construction, the number of passengers detected by the in-cage passenger number detector CPD, after being discriminated for up or down travel during the stoppage of the car, is allotted to the respective destination floors at the ratio determined by the variable resistors 01D1 to 09D1 and 02U1 to 010U1 so as to detect the signals P1D to P9D and P2U to P10U representing the numbers of passengers for destination floors.

Let us consider a case in which the car is staying at the 4th floor for up travel and cage calls have been generated at the 9th and 10th floors. The output of the passenger number detector CPD is applied to the variable resistors 010U1 and 09U1 through CPD, RUNb1, UPa1, 10Fb1, 9Ca2, 09U1 and through CPD, RUNb1, UPa1, 10Ca2 and 010U1, whereupon signals P10U and P9U representing the numbers of passengers at the respective destination floors according to the set ratio are produced at the output terminals of the variable resistors 09U1 and 010U1 respectively.

In detecting the numbers of passengers for destination floors P10D to P9D and P2U to P10U, the ratio determined by the variable resistors 01D1 to 09D1 and 02U1 to 010U1 plays a vital role in determining the accuracy with which the numbers of passengers for destination floors are determined. In an ordinary building, different floors generally have different nature and mode of use of cars, and therefore it is important to determine the above-mentioned setting ratio according to the nature and mode of the respective floors and the direction of travel of the car in order to further improve the accuracy of detection of the numbers of passengers for destination floors. For example, the ratio may be set high for those floors which are more frequented than the others or for a dispatch floor where a lobby is located. On the contrary, it may be reduced for specific floors where people are less frequented. Further, the set ratio for allotment is changed according to the direction of car travel as shown with reference to the embodiment of FIG. 4.

Also, the ratio for allotment may actually be set taking into consideration the history of prospective passengers.

Moreover, the traffic demand undergoes variations with time of the day. For instance, it is different at morning rush hours, evening rush hours and lunch time. Accordingly, it is effective to adjust and set the allotment ratio by means of the variable resistors 01D1 to 09D1 and 02U1 to 010U1 according to the traffic demand as well as the time of the day. Alternatively, the ratio may be adjusted by the use of the detection output representing the traffic demand as suggested in the U.S. Pat. Ser. No. 3,642,099.

Another method to further improve the detection accuracy may be to adjust and set the ratio of allotment according to the number of cage calls. Referring to FIG. 4, for instance, when the call only for the 10th floor is generated by five passengers who took the car at the 4th floor, the output of the in-cage passenger number detector CPD is produced at the output terminal of the variable resistor 010U1 in the form of P10U representing the number of passengers going to the 10th floor, through CPD, RUNb1, UPa1, 10Ca2 and 010U1 as mentioned already. In spite of the actual fact that there are five passengers going to the 10th floor, the signal P10U may indicate, say, three persons due to the fact that P10U is allotted according to the ratio of the variable resistor 010U1.

Figure 5A:
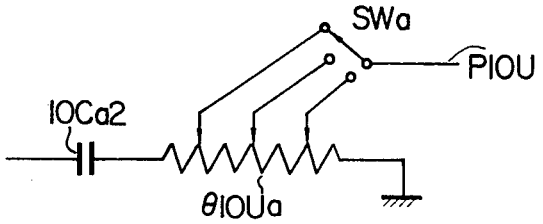
FIG. 5 is a diagram showing the means, required for each floor and each direction of car travel, to adjust the ratio at which the number of passengers is allotted, according to an embodiment of the present invention.
Figure 5B:
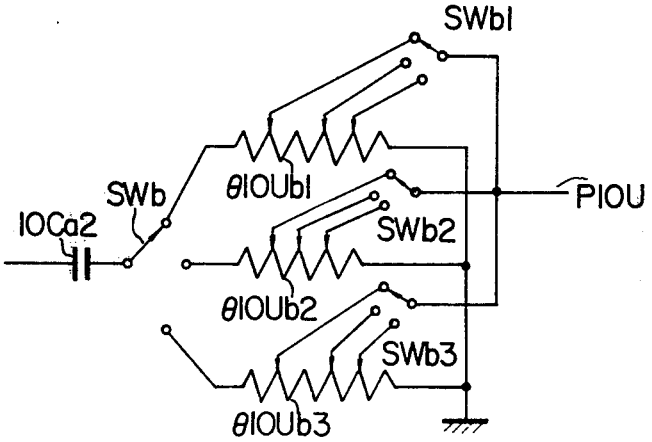

The diagrams of FIG. 5*a* and FIG. 5*b* show the cases in which the allotment ratio is set by means of variable resistors which are capable of being changed over. First referring to FIG. 5*a*, in order to adjust the allotment ratio according to the traffic demand or the above-mentioned operating time zones, the ratio which is optimum for each time zone is set in advance at the variable resistor 010Ua so as to transfer the switch SWa according to the time zone involved, thereby setting the allotment ratio for each time zone.

The diagram of FIG. 5*b*, by contrast, illustrates the system comprising a plurality of variable resistors similar to that provided in the diagram of FIG. 5*a*, whereby the allotment ratio is set according to the time zone and the number of cage calls. The variable resistors 010Ub1 to 010Ub3 are adapted to be changed over by means of the switch SWb according to the time zones. The allotment ratios corresponding to the number of calls for each time zone are set in the variable resistors 010Ub1 to 010Ub3 which are adapted to be switched by the switches SWb1 to SWb3 respectively. Therefore, it is possible to set the allotment ratio according to the number of cage calls for each time zone. By the way, the change-over operation of the switches SWa and SWb is easily effected by the personnel in charge of the elevator or by the use of a time switch. Further, a method of detecting the traffic demand is disclosed in the above-mentioned U.S. Pat. Ser. No. 3,642,099. The number of cage calls is also easily detected by the use of, say, the contact signals as derived from the contacts 2Ca2 to 10Ca2 shown in FIG. 4, through which the switches SWb1 to SWb3 are easily transferrable.

As will be seen from the above description, according to the apparatus of the invention, it is possible to detect the numbers of passengers for the floors associated with the cage calls, namely, the numbers of passengers for destination floors. Furthermore, the above detection is effected according to the characteristics or nature of the respective floors as well as the time of the day and the number of cage calls, thus making it possible to achieve a high detection accuracy suiting the respective cases.

Incidentally, the contacts 1Fb1 to 10Fb2 are provided for the purpose of cutting off the signals representing the cage calls for the floors which the car has already passed. This contributes to an improved detection accuracy by eliminating erroneous cage calls or calls by mischief. The contact RUNb1 is used in detecting the numbers of passengers for destination floors by causing an effective detection signal representing the numbers of passengers to be produced only during the stoppage of the car. In other words, the contact RUNb1 excludes the erroneous detection by the weighing device which otherwise might arise from the variation in gravitation with the acceleration and deceleration of the car. Such a detection, however, is not limited to the time of stoppage of the car but may be used effectively with a passenger-number detector not affected by the travelling situation of the car, for example, with a device employing an industrial television camera.

Figure 6:
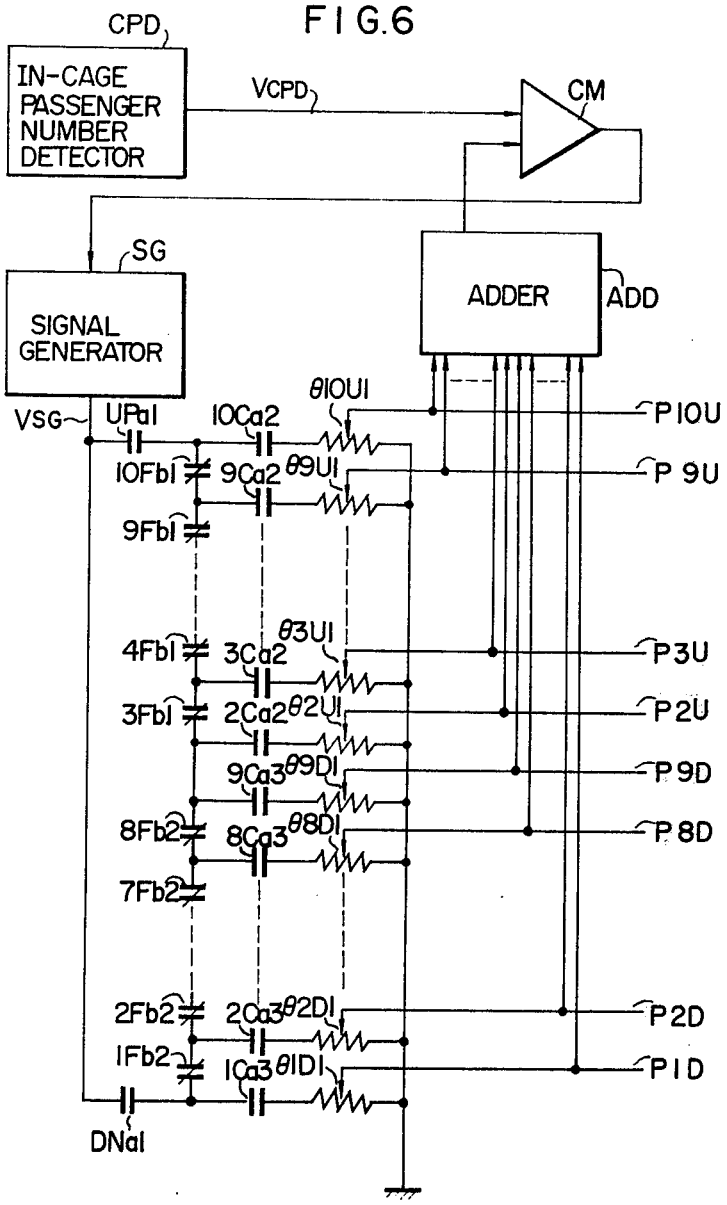
FIG. 6 is a diagram showing the means, required for each car, to detect the numbers of passengers for destination floors, according to another embodiment of the invention.

The passenger-number-for-destination-floor detector according to another embodiment of the invention is shown in FIG. 6. This embodiment is intended to further correct the result of allotment made to the floors associated with the cage calls as in FIG. 4. In other words, considering the fact that the sum of the numbers of passengers allotted to destination floors must always coincide with the total number of passengers in the car, the numbers of passengers for destination floors are adjusted to achieve such a coincidence. In the figure under consideration, like reference numerals denote like component elements with like functions in FIG. 4. Reference symbol ADD shows an adder for adding the numbers of passengers for destination floors P1D to P9D and P2U to P10U, symbol CM a comparator for comparing the output of the passenger number detector CPD with that of the adder ADD, and symbol SG a signal generator for generating a positive or negative voltage corresponding to the positive or negative output of the comparator CM. By the way, it is assumed here that the output voltages $V_{CPD}$ and $V_{SG}$ of the in-cage passenger number detector CPD and the signal generator SG respectively are at the same level.

Let us consider a case in which cage calls for the 9th and 10th floors are generated when the car is travelling upward at the 4th floor. The output voltage $V_{SG}$ of the signal generator SG corresponding to the output voltage $V_{CPD}$ of the in-cage passenger number detector CPD is applied to the variable resistors θ10U1 and θ9U1 through SG, Upa1, 10Ca2, θ10U1, and through SG, UPa1, 10Fb1, 9Ca2 and θ9U1, respectively. In this connection, it is assumed that the allotment ratios E10U1 and E9U1 are set in the variable resistors θ10U1 and θ9U1 respectively. For this reason, the numbers of passengers going to the 10th and 9th floors are determined as $V_{SG}$·E10U1 and $V_{SG}$·E9U1 respectively.

Next, the numbers of passengers for destination floors P10U and P9U are added by the adder ADD and compared with the output $V_{CPD}$ of the in-cage passenger number detector CPD in the comparator CM. At this time, the output of the adder ADD is reversed in polarity into a negative signal. As a result, the input to the comparator CM becomes $V_{CPD} - (V_{SG}\cdot E10U1 + V_{SG}\cdot E9U1)$. When this input to the comparator CM is positive, the output voltage $V_{SG}$ of the signal generator SG is increased, and vice versa. In other words, the comparator CM controls the signal generator SG in such a manner as to achieve a state where $V_{CPD} - (V_{SG}\cdot E10U1) + V_{SG}\cdot E9U1) = 0$.

It will be understood from the foregoing description that according to the embodiment under consideration the total number of passengers in the car always coincides with the sum of the numbers of passengers for destination floors and therefore it is possible to effect an optimum detection of the numbers of passengers for destination floors at the set allotment ratio. For example, in the case where five persons get on the car at a certain floor and one cage call is generated as mentioned already, it is accurately detected that there are five passengers riding in the car and associated with the one cage call, thus eliminating the need for the setting device as shown in FIG. 5*b*.

In spite of the above-mentioned method in which the numbers of passengers for destination floors are corrected by the use of the signal generator SG in such a manner as to achieve coincidence between the total number of in-cage passengers and the sum of the numbers of passengers for destination floors, there are still other methods for achieving such a coincidence. For example, the numbers of passengers for destination floors may alternatively be corrected by adjusting the variable resistors θ1D1 to θ9D1 and θ2U1 to θ10U1 to achieve such a coincidence.

As will be easily seen from the above description, according to the present invention, it is possible to provide a device whereby the numbers of passengers for destination floors are detected as an additional type of traffic information. Therefore, the use of the apparatus according to the invention enables a more highly accurate and reliable elevator control, thus offering a better service in the operation of a high-performance elevator system.

The passenger-number-for-destination-floor detector according to another embodiment will be explained below.

In the embodiment under consideration, for example, the numbers of passengers for destination floors as at the 1st floor are detected from the number of passengers at the 1st floor and cage calls, thus storing in memory the numbers of passengers for destination floors. If the car travels up and stops at the 2nd floor and passengers get on and off or new cage calls are generated at the 2nd floor, then the numbers of passengers for destination floors already in memory are corrected in accordance with the change in the number of passengers or cage calls occurred at the second floor.

The embodiment under consideration will be described below more in detail.

Figure 7:
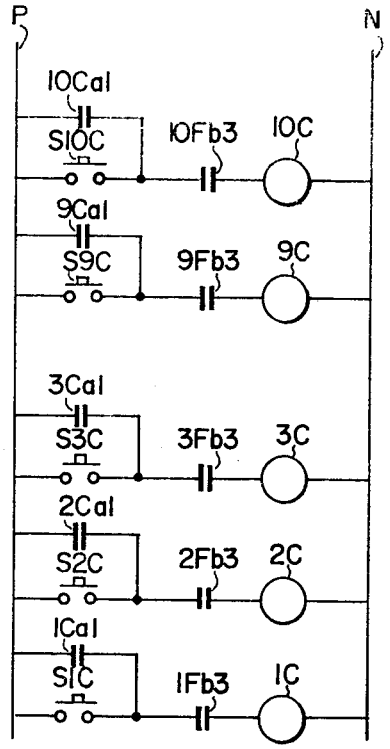
FIG. 7 to FIG. 12 show the means for detecting the numbers of passengers for destination floors according to still another embodiment of the invention; including FIG. 7 showing a conventional circuit, required for each car, to register cage calls.

A cage call registration circuit is shown in FIG. 7. The contacts 1C*a*2 to 10C*a*3 which are energized at the time of registration of cage calls in the embodiment of FIG. 4 and FIG. 6 make up *a* contacts of the relays 1*c* to 10*c* in FIG. 7.

In the drawing under consideration, reference numerals 1*c* to 10*c* show relays energized at the time of registration of cage calls as already mentioned. In the event that the cage call button S9*c* is pushed and a cage call for the 9th floor is generated, for instance, the relay 9*c* is energized through P, S9*c*, 9F*b*3, 9*c* and N. At the same time, the contact 9*cal* of the relay 9*c* is energized, so that the relay 9*c* is self-held through P, 9*cal*, 9F*b*3, 9*c* and N. Subsequently, with the arrival of the car at the 9th floor, the contact 9F*b*3 of the relay which is turned on in response to a signal indicating the car position of the 9th floor is turned off, thereby releasing the relay 9*c* from the self-held state. As a result, the registration of the cage call for the 9th floor is cleared. This is also the case with the other relays 1*c* to 8*c* and 10*c* provided for the respective floors (some of which are not shown in the drawings). The contacts 1*ca* to 10*ca* and 1*cb* to 10*cb* of the relays are inserted in the circuit described later.

A car-in-travel detector circuit is shown in FIG. 8. Reference numerals 1*cc* to 10*cc* denote relays energized when the car travels after the generation of a cage call. Assume that the cage call for the 9th floor is registered in the circuit of FIG. 7 and the relay 9*c* energized. The contact 9*ca*4 of FIG. 8 is turned on. When the car begins to move under this condition, the contacts RUN*al* to RUN*a*4 which are turned on with the movement of the car are energized, so that the closed circuit through P to RUN*a*2 to 9*ca*4 to 9*cc* to N is formed thereby to turn on the relay 9*cc*. At the same time, the relay 9*cc* is self held by its contact 9*ccal*. This self-held state of the relay 9*cc* is maintained until the registration of the cage call for the 9th floor is cleared. The same can be said of the relays 1*cc* to 8*cc* and 10*cc* provided at the respective floors, and their contacts 1*cca* to 10*cca* and 1*ccb* to 10*ccb* are inserted in the circuits later described.

Circuit configurations of the passenger-number-for-destination-floor detector constituting a feature of the embodiment under consideration are shown in FIG. 9 to FIG. 12.

First referring to FIG. 9 showing a circuit for detecting the numbers of passengers for destination floors in response to an additional cage call, the output $V_{ADD1}$ of the adder ADD1 and the output $V_{CPD}$ of the in-cage passenger-number detector CPD are compared in the comparator CM1, so that the signal voltage generator SG1 produces an output voltage $V_{SG1}$ in response to the output of the comparator CM1. In other words, the comparator CM1 operates in such a manner as to produce an output representing $V_{CPD}$ less $V_{ADD1}$, whereupon the signal voltage generator SG1 increases or decreases its output voltage $V_{SG1}$ in accordance with the positive or negative output signal of the comparator CMl respectively. As a result, if the output of the comparator CM1 is in the state of 0, the output voltage $V_{SG1}$ is maintained as it is. The input signals PP1D to PP10U to the adder ADD1 and the signal $V_{ASD2}$ are those derived from the circuits of FIG. 11 and FIG. 12 as described later. The contacts UP*a*2 and DN*a*2 are energized when the car is in up and down travel respectively as mentioned already. The variable resistors *θ*2U2 to *θ*10U2 and *θ*1D2 to *θ*10D2 are for generating the signals P1D to P9D and P2U to P10U by dividing the output voltage $V_{SG1}$ of the signal voltage generator SG1 at an appropriate ratio, like the variable resistors *θ*1D1 to *θ*10U1 included in the embodiment of FIG. 4.

A circuit for storing in memory the numbers of passengers for destination floors is shown in FIG. 10. The contacts with reference symbols similar to those shown in the preceding embodiment operate in like manner. The memory elements AM1D1 to AM10U1 produce the signals PP1D to PP10U in response to inputs P1D to P10U, respectively, applied thereto from the circuit of FIG. 9. The signals PP1D to PP10U are applied not only to the circuit of FIG. 9 but to the adders ADD1D to ADD10U at the same time. The adders ADD1D to ADD10U are also impressed with the signals 1DP to 10UP respectively from the circuit of FIG. 11, while applying the outputs thereof to the memory elements AM1D2 to AM10U2 when the contacts RUN*b*5 to RUN*b*10 are in the energized respectively, namely, as long as the car is stationary. The outputs of the memory elements AM1D2 to AM10U2 are applied to the memory elements AM1D1 to AM10U1 respectively when the contacts RUN*a*5 to RUN*a*7 are in the state of ON, that is, when the car is in movement. The other contacts with only their suffixes different from those of the above-mentioned contacts operate similarly.

The diagram of FIG. 11 shows a circuit for correcting the numbers of passengers for destination floors, in which the contacts with only their suffixes different operate similarly to each other. Reference symbol ASD1 shows an adder-subtractor which is impressed with the output voltage $V_{CPD}$ of the passenger number detector CPD of FIG. 9 as an add input thereof through the contact Dca adapted to be energized when the car door is closed. The memory element AMM, on the other hand, is impressed with the output voltage $V_{ADD1}$ of the adder ADD1 of FIG. 9 through the contact Doa which is adapted to be energized while the car door is open, while applying its output voltage $V_{AMM}$ to the adder-subtractor ASD1 as a subtract input. The output voltage $V_{ASD1}$ of the adder-subtractor ASD1 makes up an add input to the add-subtractor ASD2. The adder-subtractor ASD2 is impressed with the signal *vo* from the circuit of FIG. 12 as a subtract input thereto. The output voltage $V_{ASD2}$ from the adder-subtractor ASD2 is applied to the comparator CM3, which in turn is impressed with the output voltage $V_{ADD2}$ of the adder ADD2 and produces a positive or negative signal according to the result of operation $V_{ASD2} - V_{ADD2}$. The circuit elements subsequent to the signal voltage generator SG2 operate the same way as those in the circuit of FIG. 6 or FIG. 9, and apply their outputs 1DP to 10UP to the adder ADD2. In this way, the signal voltage generator SG2 is driven in such a manner that the output voltage $V_{ASD2}$ of the adder-subtractor ASD2 is equal to the output voltage $V_{ADD2}$ of the adder ADD2. In the circuit under consideration, it was assumed that the adder-subtractors ASD1 to ASD2 produce only a positive output but no negative output.

The circuit of FIG. 12 is for detecting the number of additional cage calls generated, in which the contacts with only their suffixes different are assumed to operate similarly. Reference symbols $r$ and $r_0$ show resistors having the relation $r > r_0$ with each other. This circuit detects the number of newly generated cage calls the floors associated with which have not yet been passed by the car after the registration thereof. The output voltage vo is proportional to the number of such additionally generated cage calls.

In the circuits of FIG. 9 to FIG. 12, it is assumed that five persons have got on the car staying at the first floor for up travel and pushed the cage call button S9*c* for the 9th floor. The voltage $V_{CPD}$ corresponding to the five passengers in the car is detected by the in-cage passenger number detector CPD of FIG. 9 and is applied to the comparator CM1. In response to this input, the comparator CM1 produces a positive output signal thereby to increase the output voltage $V_{SG1}$ of the signal voltage generator SG1. The output voltage $V_{SG1}$ is applied through $V_{SG1}$, UP*a*2, 9*ca*5, 9*ccbl*, *θ*9U2 and P9U further to the circuit of FIG. 10.

In FIG. 10, the contacts 9cab and 9ccb2 are energized and therefore the signal P9U is applied through P9U, 9*cab*, 9*ccb*2 and AM9U1. The output PP9U of the memory element AM9U1 is applied to the adder ADD9U and at the same time to the adder ADD1 of FIG. 9. The output $V_{ADD1}$ of the adder ADD1 is compared with the output $V_{CPD}$ of the in-cage passenger number detector CPD in the comparator CM1, so that the output $V_{SG1}$ of the signal voltage generator SG1 is adjusted to make zero the sum of the two inputs to the comparator CM1. When the output of the comparator CM1 is zero, the signal voltage generator SG1 holds its output $V_{SG1}$. At this time, the signal P9U and signal PP9U are equal to the voltage $V_{CPD}$ representing the number of passengers in the car, each being a voltage corresponding to five passengers. In other words, the signals P1D to P10U store the numbers of passengers for destination floors for up and down travel respectively at the 1st to 10th floors each time of floor service of the car, while the signals PP1D to PP10D store the numbers of in-cage passengers for destination floors which are corrected in accordance with the changes in the number of in-cage passengers or cage calls due to each stoppage of the car.

In view of the assumed fact that five persons got on the car at the first floor for up travel and the only cage call generated is for the 9th floor, the circuit of FIG. 9 detects that there are five persons going to the 9th floor and no person going to the other floors, with the result that only the passenger-number-for-destination-floor signal P9U for the 9th floor is generated in the form of a signal representing 5 passengers, while all the other passenger-number-for-destination-floor signals remain in the state of zero. Further, the memory element AM9U1 of FIG. 10 memorizes the fact that there are 5 passengers going to the 9th floor, while the other memory elements store zero.

The variable resistors θ1D2 to θ10U1 in FIG. 9 are for setting the ratio at which the number of passengers is allotted to each floor by the direction of car travel, and operate as mentioned already with reference to the preceding embodiment.

Next, assume that, after detecting that five persons got on the car at the 1st floor for up travel, the car begain to move and stopped at the second floor. Also, assume that additional two persons got on the car at the second floor and pushed the cage call button S10*c* for the 10th floor thereby to self-hold the relay 10*c*. The fact that the car has travelled from the 1st floor to the 2nd floor causes the relay 9*cc* in the closed circuit P to RUN*a*2 to 9*ca*4 to 9*cc* to N to be energized and self held through P, 9*ccal*, 9*ca*4, 9*cc* and N.

As a result, the signal P9U of FIG. 9 is not any longer applied to the circuit of FIG. 10, even though it is stored in the memory element AM9U1 of FIG. 10.

In the circuit of FIG. 9, the in-cage passenger number detector CPD produces an output $V_{CPD}$ representing seven passengers. Since the output $V_{ADD1}$ of the adder ADD1 represents five passengers, the comparator CM1 produces a positive output, thus increasing the output voltage $V_{SG1}$ of the signal voltage generator SG1. Since the contact 10*ca*5 is turned on and the contact 9*ccb* off, the output voltage $V_{SG1}$ of the signal voltage generator SG1 is transmitted through $V_{SG1}$, UP*a*2, 10*ca*5, 10*ccbl* and θ10U2, and in a manner similar to the preceding case, a new in-cage passenger number signal P10U for the 10th floor representing two persons is produced.

On the other hand, in the circuit of FIG. 11 for correcting the numbers of passengers for destination floors, the contact D*oa* is turned on as the car is stopped and the door opens, so that the output $V_{ADD1}$ of the adder ADD1 in FIG. 9 is stored in the memory element AMM.

With the subsequent closing of the door after two persons have got on the car, the contact D*ca* adapted to be turned on during the closed state of the door is energized. As a result, the adder-subtractor ASD1 calculates the formula $V_{CPD} - V_{AMM}$ with the output $V_{CPD}$ of the passenger number detector CPD as an add input thereto, and produces an output $V_{ASD1}$. This output $V_{ASD1}$ makes up a voltage representing two persons and is applied as an add input to the adder-subtractor ASD2. A subtract input to be applied to the adder-subtractor ASD2 is the call-number signal vo derived from the number-of-new-cage-call number detector circuit shown in FIG. 12. In FIG. 12, the fact that a cage call is generated at the 2nd floor for the 10th floor causes only a circuit to be formed from P to 10*ca*7 to 10*ccb*3 to *r* to $r_0$, so that the voltage of the call number signal vo corresponds to one call. It is assumed here that the resistors *r* and $r_0$ are adjusted in such a manner that the call number signal *vo* makes up a voltage representing, say, two passengers. The subtract input to the adder-subtractor ASD2 makes up a voltage corresponding to two passengers, with the result that no output is produced from the adder-subtractor ASD2 and therefore no subsequent circuits are energized.

The new in-cage passenger number for destination floor signal P10U for the 10th floor makes up a signal representing two persons, so that the value stored as zero at the 1st floor in the memory element AM10U1 in FIG. 10 is corrected to two persons. It is thus detected that the numbers of in-cage passengers for destination floors are five for the 9th floor, two for the 10th floor and zero for the other floors.

By the way, it will be seen from FIG. 10 that the memory elements AM1D1 to AM10U1 are reset when the car reaches the respective floors as the relays 1*c* to 10*c* are released from their self-held state. The memory element AM9U1 for the 9th floor, for example, is reset when the relay 9*c* is turned off through the turning off of the contact 9F*b*3 of a relay which is adapted to be turned on when the car is at the 9th floor. As a result, the memory element AM9U1 is reset before the elevator door enters an opening operation.

Apart from an example of operation of the apparatus according to the invention, another example thereof will be explained below in which it is assumed that one person gets on at the 1st floor and registers a cage call for the 9th floor while five additional persons get on the car at the second floor and register a cage call for the 10th floor. (In this case, the new cage call is only for the 10th floor, even though among the five persons who got on the car at the second floor there may be some who go to the 9th floor for which the cage call has already been registered.)

At the 1st floor, it is detected that as in the preceding case the number of in-cage passengers who go to the 9th floor is one and those for the other floors are zero, so that the memory elements AM1D1 to AM10U1 store voltages respectively corresponding to the above-mentioned numbers of in-cage passengers for destination floors.

At the second floor, five additional persons get on the car and therefore as in the preceding case the in-cage passenger number for destination floor signal P10U for the 10th floor in FIG. 9 becomes a voltage corresponding to five persons.

In the circuit of FIG. 11, on the other hand, the adder-subtractor ASD1 operates the formula $V_{AMM} - V_{CPD}$ and produces an output voltage $V_{ASD1}$ corresponding to the five new comers at the second floor, during the car door closing operation. The adder-subtractor ASD2 is impressed with the output voltage $V_{ASD1}$ as an old input and with the call number signal vo from the circuit of FIG. 12 as a subtract input thereto. The call number signal vo represents a signal corresponding to two passengers since there is only one new cage call as in the preceding case. As a result, the adder-subtractor ASD2 operates the formula $V_{ASD1} - vo$ and produces an output voltage $V_{ASD2}$ representing three passengers, so that the comparator CM3 produces a positive output signal thereby to increase the output voltage $V_{SG2}$ of the signal voltage generator SG2. In view of the fact that the previously registered cage call is only for the 9th floor, the relay *9cc* in FIG. 8 is energized. Consequently, the output voltage $V_{SG2}$ of the adder-subtractor SG2 is transmitted through UPa, *9cca*, 09U2, ADD2 and CM3, whereupon the signal 9UP becomes a voltage corresponding to three passengers.

By the way, the signals 1DP to 10UP are for correcting the numbers of passengers for destination floors for the floors associated with the cage calls already registered before the stoppage of the car at the respective floors. This is somewhat different from the method in the preceding case in which the numbers of in-cage passengers for destination floors are corrected for the floors associated with the cage calls not registered before the stoppage of the car. Therefore, the correction of the numbers of in-cage passengers for destination floors by the signals 1DP to 10UP will be specifically referred to as the "amendment" as discriminated from the other corrections in the present specification, even though the "correction" includes the "amendment". Thus the signals 1DP to 10UP will be called hereinafter as the passenger-number-for-destination-floor-amendment signals.

The passenger-number-for-destination-floor-amendment signal for the 9th floor that is detected as above is applied to the adder ADD9U in FIG. 10. The adder ADD9U is also impressed with the other input in the form of the value stored in the memory element AM9U1 and applies its output, that is, the result of addition (1 + 3) to the memory element AM9U2. The value stored in the memory element AM9U2 is applied through AM9U2, RUNa6 and AM9U1 during the travelling of the car thereby to amend the value stored in the memory element AM9U1.

On the other hand, the output voltage $V_{ASD2}$ representing three passengers which is derived from the adder-subtractor ASD2 of FIG. 11 is applied to the adder ADD1 in FIG. 9 and added to another signal therein. As a result, the comparator CM1 produces a negative signal, whereupon the output signal $V_{SG1}$ of the signal voltage generator SG1 is decreased. The voltage representing five passengers which is made up of the in-cage passenger number for destination floor signal P10U is decreased to another signal representing two passengers. In the meantime, the contact 10*ccb*2 in FIG. 10 is still in energized state as the car has not yet started. When the car starts to move, the passenger number for destination floor signal P10U for the 10th floor representing two passengers is stored in the memory element AM10U1, with the result that the number of in-cage passengers for destination floor for the 10th floor which has been zero before the car arrival at the 2nd floor is corrected to read two.

As will be understood from the foregoing description, even when five persons get on the car at the 2nd floor and only one new cage call is generated, correction is made on the assumption that there are some passengers who go to the floor associated with the cage call already registered. As a consequence, the numbers of in-cage passengers for destination floors for the 9th and 10th floors are determined to be four and two respectively, so that the in-cage passenger-number-for-destination-floor-memory signals PP9U and PP10U in FIG. 10 take forms representing the above-mentioned numbers of passengers respectively.

In connection with the foregoing description, also assume that additional two cage calls are generated at the 2nd floor. The call number signal *vo* in FIG. 12 becomes a voltage representing four persons, and so the in-cage passenger number for destination floor amendment signal 9UP for the 9th floor, with the result that smaller numbers of passengers than four are detected as representing passengers associated with new cage calls.

The adder-subtractor ASD1 in the in-cage passenger number for destination floor correction circuit in FIG. 11, as will be understood from the preceding explanation, detects the difference between the number of in-cage passengers except for the numbers of passengers by destination floors which are associated with the service floors and the number of passengers in the car at the time of the starting of the car. Therefore, even when more persons get off than the numbers of in-cage passengers for destination floors which are associated with the service floors, the numbers of passengers for destination floors can similarly be corrected by the use of the negative output voltage of the adder-subtractor ASD1. For this operation, it will be obvious that there is no need for the adder-subtractor ASD2 but the signal voltage generator SG2 may be driven directly with the above-mentioned negative output voltage. Incidentally, in the event that some persons get on and off at the service floors, there may occur an error, which can be similarly corrected by detecting the number of passengers with a conventional counter and a photoelectric device provided appropriately at the car entrance for detecting the number of persons getting on and off the car. Also, instead of the output of the adder-subtractor ASD2, the output $V_{ADD2}$ of the adder ADD2 may be applied as an add input to the adder ADD1 in FIG. 9.

As explained above, the present invention is such that the numbers of in-cage passengers for destination floors are stored in memory and therefore can be corrected in accordance with subsequent variations in the number of in-cate passengers or the cage calls. As a result, accurate correction of the numbers of passengers for destination floors can be performed as against the subsequent change in the number of in-cage passengers or cage calls at each service floor, thus making possible accurate detection of the numbers of in-cage passengers for destination floors. This leads to a high-performance control of elevator cars as already mentioned.

The passenger number for destination floor correction circuit of FIG. 11 according to an embodiment of the present invention is shown in FIG. 13. As will be seen from the drawing in question, the fundamental circuit configuration is substantially the same as that of the circuit of FIG. 11 and therefore its detailed operating principle will not be explained here. In the embodiment under consideration, the adder-subtractor ASD3 is always impressed with the output $V_{CPD}$ of the passenger number detector CPD and the output $V_{ADD1}$ of the adder ADD1. The comparator CM4 is for comparing the output of the adder-subtractor ASD3 with that of the adder ADD3. The signal voltage generator SG3 is impressed with the output signal of the comparator CM4 through the contact DCa energized when the elevator door is closed. Only when there is a difference between the number of in-cage passengers and the sum of the numbers of passengers for destination floors, the signal voltage generator SG3 is energized and produces the in-cage passenger number for destination floor amendment signals 1DP to 10UP. In other words, according to the circuit under consideration, it is possible that the number of passengers in the car always coincide with the sum of the numbers of in-cage passengers for destination floors.

The present invention is not limited to the various embodiments described above with reference to actual examples of the number of passengers for destination floor detector, but may be modified as desired in appropriate ways.

By securing this new traffic information in the form of the numbers of passengers for destination floors, a high-performance elevator control taking into consideration the numbers of passengers for destination floors is made possible. In other words, it is possible to improve the elevator operating efficiency on the one hand and to improve the service to the elevator passengers on the other.

Next, the description will be made of the elevator control utilizing the information on the numbers of passengers for destination floors, or more specifically actual examples of the elevator control apparatus explained with reference to FIG. 1 to FIG. 3.

First, the diagrams of FIG. 14 to FIG. 21 show the portions of the apparatus corresponding to the interval control device as mentioned already, in which FIG. 14 shows a circuit for detecting the spatial interval with an immediately succeeding car, which is provided for each car. The explanation below assumes that the 10 floors from the 1st to the 10th floors are served by three cars including cars A, B and C and will be substantially concentrated on the control apparatus for car A. In the drawings, the reference symbols denote the following-defined component elements or signals:

F1UA to F9UA: The position signals for the 1st to 9th floors of car A in up travel

F2DA to F10DA: The position signals for the 2nd to 10th floors of car A in down travel.

F1UB to F9UB: The position signals for car B in up travel.

F2DB to F10DB: The position signals for car B in down travel

F1UC to F9UC: The position signals for car C in up travel.

F2DC to F10DC: The position signals for car C in down travel.

C1UA1 to 09UA2 and 02DA1 to 010DA2: OR elements I1UA to I9UA and I2DA to I10DA: Inhibit elements $r_1$ and $r_0$: Resistors

*da:* The signal representing the spatial interval between car A and the immediately succeeding car.

As illustrated in the drawing, the elevator service floors are connected endlessly through F1U, F2D, F3D, . . . F9D, F10D, F9U, F8U, . . . F2U and F1U, so that the position signal for car A is transmitted in sequence through this chain until it is cut off by the position signal for car B or car C. At this time, the signal *da* corresponding to the spatial intervals of the respective cars is obtained by applying the signals from the respective floors through the resistors $r_1$ and $r_0$.

Let us consider a case, for example, in which car A is moving up at the 8th floor, car B moving down at the 2nd floor and car C moving down at the 5th floor. (In this case, the car immediately following car A is car B) The position signal F8UA for car A is transmitted through F8UA, O8UA1, I8UA, O7UA1, . . . I3UA, O2UA1 and I2UA. However, in view of the fact that the position signal F2UB for car B is in the state of "1" thereby to prohibit the operation of I2UA in the loop comprising F2UB, O2UA2 and I2UA, the output signal of I2UA is "0", thereby preventing the signal from being transmitted any farther.

As will be noted from the above description, the output signals of I8UA, I7UA, . . . I4UA and I3UA are in the state of "1" and therefore the position signal representing the 6-floor interval is produced across the resistor $r_0$ through the resistor $r_1$ in the form of signal *da.* Under this condition, if the relation between resistors $r_1$ and $r_0$ is such that $r_1 >> r_0$, a signal proportional to the number of floors is produced across the resistor $r_0$. In other words, the signal *da* which is proportional to the spatial interval with the immediately succeeding car is obtained.

A circuit for detecting the number of calls to be served by car A is shown in FIG. 15, in which reference symbols M1UA to M9UA and M2DA to M10DA show signals requiring the stoppage of car A, which are an ideal combination of the direction of elevator car travel and the hall calls and cage calls to be served. Like the circuit of FIG. 14, the voltage signal CA proportional to the number of calls is obtained through the resistors $r$ and $r_0$.

The circuit of FIG. 16 is for adding the number of calls to be served by each car and calculating the average number of calls to be served by each car. Symbols CA to CC show the numbers of calls to be served by cars A to C respectively which are obtained as in FIG. 15, and symbols NoA1, NoA2, NoB1, NoB2, NoC1 and NoC2 show contacts which are opened when cars A to C are released from the controlled operation respectively. Symbol $R_1$ shows an operational resistor, and symbol OP1 an operational amplifier for reversing the polarity of the input and output thereof.

In the case where cars A to C are in a controlled operation, the contacts NoA1, NoA2, NoB1, NoB2, NoC1 and NoC2 are all closed. Under this condition, the output C of the operational amplifier is expressed as $$C = \frac{-\frac{R_1}{3}}{R_1}(CA + CB + CC)$$

$$= -\frac{1}{3}(CA + CB + CC) \qquad (1)$$

where *CA*, *CB* and *CC* are call inputs to cars *A* to *C* respectively.

In the event that a given car, say, car A is released from controlled operation, $$C = \frac{-\frac{R_1}{2}}{R_1}(CB + CC) = -\ \tfrac{1}{2}\ (CB + CC)$$

In other words, the output *C* of the operational amplifier calculates the average value of the number of calls to be served by the respective cars.

The diagram of FIG. 17 shows a circuit for producing a reference voltage for the comparator in FIG. 18. Assuming that cars A to C are in controlled operation, the contacts NoA3 to NoC3 are open and therefore the output C of the operational amplifier OP2 is expressed by the following equation:

$$Vop2 = \frac{-R_4}{R_3}(-V) = \frac{R_4}{R_3}V$$

Assume that the values of resistors $R_3$, $R_4$ and $R_0$ are selected appropriately thereby to make the V*op*2 of, say, 6 volts. If car A is released from the controlled operation, the contact N*o*A3 is closed and the output of the operational amplifier OP2 is given as $$Vop2 = -\frac{R_4}{R_3}(-V) - \frac{R_4}{R_2}(-V)$$

$$= R_4V\left(\frac{1}{R_3} + \frac{1}{R_2}\right) \quad (2)$$

If the value of $R_2$ is selected appropriately, it is possible to obtain V*op*2 of, say, 10 volts. In this manner, by dividing appropriately the output voltage of the operational amplifier through the resistors $R_5$ and $R_6$, the reference voltages $V_1$ and $V_2$ are obtained for the comparators. When V*op*2 is 6 volts as above, for example, the outputs of $V_1$ and $V_2$ are 5V and 4V respectively, while they are 8.3V and 6.6V when V*op*2 is 10 volts.

The diagram of FIG. 18 shows a circuit for determining the time interval of car A, which is impressed with inputs thereof from the circuits of FIG. 14 to FIG. 17. In the drawing under consideration, the following reference symbols denote the following-defined meanings:

OPA1 and OPA2: operational amplifiers

CMA1 and CMA2: comparators each of which produces a "1" output when the sum of the two inputs thereto is zero or positive.

NA: NOT element

IH: inhibit element

E0A to E2A: time interval determining signals for advancing car A from its actual position to a provisional position.

For instance, E0A advances car A zero floor, E1A one floor and E2A two floors.

The average number of calls obtained from FIG. 16 is subtracted from the number of calls CA to be served by car A which is derived from the circuit of FIG. 15, in the operational amplifier OPA1, with the result that the amplifier OPA1 produces an output $$VopA1 = -(CA + C) = -CA + \tfrac{1}{3}(CA + CB + CC) \quad (3)$$

In like manner, the operational amplifier OPA2 produces an output $$VopA2 = -\frac{R_{9A}}{R_{7A}}VopA2 - \frac{R_{9A}}{R_{8A}}da \quad (4)$$

By selecting appropriately the ratios between the resistors $R_{7A}$ to $R_{9A}$, it is possible to set a voltage corresponding to the car interval of one floor at 1V and a voltage corresponding to one call at 3 volts or thereabouts. In other words, by appropriately selecting the weight of the car interval and that of calls, the time interval of the cars can be determined. From the above formula, $$VopA2 = -K_1\left(-CA + \frac{CA + CB + CC}{3}\right) - K_2 \cdot da$$

-continued $$= K_1CA - \frac{K_1}{3}(CA + CB + CC) - K_2 \cdot da \quad (5)$$

As will be easily noted from this equation, when the number of calls to be served is equal to the average number of calls, the first and second terms in equation (5) are equal to each other and therefore $VopA2 = -K_2 \cdot da$. However, if the number of calls to be served by car A is larger than the averal number of calls by, say, one, then $K_1CA - K_1/3\ (CA + CB + CC) = +3V$. On the contrary, if the number of calls to be served is smaller than the average number of calls by one, $$K_1CA - K_1/3\ (CA + CB + CC) = -3V$$

As will be understood from above, a time interval of a car taking into consideration the number of calls is obtained.

It is assumed that the interval of car A from the immediately succeeding car is 6 floors and the number of calls to be served by car A is more than the average number of calls by one. $VopA2 = +3V - 6V = -3V$. Reference signals $V_1$ and $V_2$ of $5V$ and $4V$ respectively are assumed to be applied to the comparators CMA1 and CMA2 respectively. Then the comparator CMA1 produces an output signal in the state of "1" in response to the inputs of $-3V$ and $5V$, while the comparator CMA2 similarly produces an output signal "1" in response to the inputs of $-3V$ and $4V$. As a result, the output signal of E2A becomes "1", so that the signal E1A is in the state of "0" because the inhibit element IH is deenergized, whereas signal E0A is also in the state of "0" since a "1" signal is applied to the NOT element NA.

In the case where $VopA2$ is $-5V$, on the other hand, the comparator CMA1 produces a "1" signal in response to the inputs thereto of $-5V$ and $5V$, whereas the output of the comparator CMA2 is in the state of "0" since its inputs is $-5V$ and $4V$. In this way, the comparators CMA1 and CMA2 determine the time interval of the car and produce signals E0A to E2A.

The circuits of FIG. 19 to FIG. 21 are for determining the provisional service zone of car A by the position signal for car A and the time interval signal for the same. In the drawings, the following reference symbols denote the component elements or signals as defined respectively:

A1UA1 to A9UA4 and A2DA1 to A10DA4: AND elements O1UA3 to O9UA5 and O2DA3 to O10-DA5: OR elements IN1UA1 to IN9UA3 and IN2-DA1 to IN10DA3: inhibit elements 1U to 9U and 2D to 10D: signals formed by OR elements as shown in FIG. 21, respectively M1U to M9U and M2D to M10D: signals formed as shown in FIG. 20

S1UA to S9UA and S2DA to S10DA: signals connected to the circuit of FIG. 22

L1UA to L9UA and L2DA to L10DA: service zone signals connected to the circuit of FIG. 22

AM1U to AM9U and AM2D to AM10D: inserviceability signals derived from the circuit of FIG. 16

In the above-described construction, let us consider a case in which spatial position signal E0A is generated for both car A travelling up at the 2nd floor and for car B which is travelling down at the 10th floor in advance of car A. (It is assumed that car C is travelling down at the 5th floor.) The operation for determining the provisional service zones under this condition will be explained below.

The fact that car A is at the 2nd floor and the E0A signal in the state of "1" causes the AND element A2UA1 to produce a "1" signal which is applied through the OR elements O2UA3, O2UA5 and IN-2UA2. The signal from O2UA5, on the other hand, is applied to the inhibit element IN3UA1 for the 3rd floor (not shown) and further from the 3rd to the 7th floors in sequence. The signal for the 7th floor is applied to the inhibit element IN8UA1 and transmitted therefrom through O8UA5, IN8UA2, O9UA5, IN9UA2 and IN1-0DA1. In response to these signals, the output signal of the inhibit elements IN3UA3 to IN9UA3 become "1" respectively. On the other hand, the signal from O2UA3 is applied to the OR element O2UA4 and takes the form of a signal 2U through the circuit like the one in FIG. 21. In other words, one of the inputs to the OR element O2UA4 for car A is O2UA3 and the other input is left open. The output of O2UA4 is connected to O2UB4 and IN2UB2 for car B, and the output of O2UB4 is applied to the OR element O2UC4 and IN-2UC2 for car C. The output of O2UC4 takes the form of signal 2U and is applied as an inhibiting input to the inhibit elements IN2UA1, IN2UB1 and IN2UC1.

Therefore, the signals O2UA3 to O2UC3 for the respective cars are such that the inhibit elements IN-2UA2, IN2UB2 and IN2UC2 are inhibited in the priority order of cars A, B and C.

As will be noted from the foregoing explanation, the signal "1" from the OR element O2UA3 for car A becomes signal 2U whereby the provisional-service-zone-setting circuits for cars A, B and C are all prohibited. In the case in question, the input signal to the inhibit element IN2UC1 for car C is prohibited thereby to produce an output in the state of "0".

In like manner, the fact that car B is travelling down at the 10th floor causes the signal 10D to take the form of "1" with the result that the inhibit element IN1-0DA1 for car A is prohibited in operation thereby to produce an output signal in the state of "0", whereupon the output signals from IN3UA3 to IN9UA3 for car A take the state of "1". Consequently, the provisional service zone for car A is determined to be 2U to 9U, that for car B to be 10D to 6D and that for car C to be 5D to 2D and 1U, so that car A produces signals L2UA to L9UA, car B signals L10DB to L6DB and car C signals L5DC to L2DC and L1UC.

The circuit shown in FIG. 19, as its detailed operation will be described later, is thus capable of producing the true service zone signals L1UA to L9UA and L2DA and L10DA by excluding from the provisional service zone those calls unable to be served. Thus the inserviceability signals are made up of AM1U to AM9U and AM2D to AM10D.

The diagram of FIG. 20 shows a circuit common to all the cars for generating interlock signals M1U to M9U and M2D to M10D for interlocking the operation of the cars so as to prevent them from serving a call at the same time. This circuit produces an output in response to an output generated by the energization of one of the service decision relays shown in FIG. 23 and is used for prohibiting the other cars from serving the same hall call generated at the same floor for travel in the same direction. (The operation of such a prohibition is performed by the circuit of FIG. 22.)

FIG. 22 shows a circuit for allotting to a succeeding car the hall call which has not been allotted to any car by being eliminated from the above-mentioned true service zone, in which car A is taken as an example. (Detailed description will be made later.)

The circuit of FIG. 23 is for allotting hall calls for car A to the other cars on the basis of the true service zone as determined above and the service zone signals LL1UA to LL9UA and LL2DA to LL10DA additionally supplied by the circuit of FIG. 22, as will be described more in detail later. In this Figure, HC1U-HC9U as well as HC2D-HC10D designate contacts of relays which remain in the on state when up hall calls at the 1st to the 9th floors and down hall calls at the 2nd to 10th floors are registered, respectively.

The diagrams of FIGS. 24 to 26 show circuits for detecting the numbers of passengers for destination floors as already mentioned, forecasting the numbers of in-cage passengers at the leading floors, and deciding the serviceability of the respective cars. First, the circuit of FIG. 24 for car A is constructed quite the same way as the circuit in FIG. 6 for detecting the numbers of passengers for destination floors. The circuit under consideration, whose operation is already described, produces the signals P2UA to P10UA and P1DA to P9DA representing the numbers of in-cage passengers for destination floors for car A. Incidentally, it will be obvious that the circuits of FIG. 8 to FIG. 12 may be equally applied as the detector for the numbers of in-cage passengers for destination floors, and such a detector is described in the present control apparatus with reference to the circuit of FIG. 6.

The number-of-passengers-for-destination-floor signals P2UA to P10UA and P1DA to P9DA are applied to the circuit of FIG. 26.

The diagram of FIG. 25 shows a distribution circuit for applying a signal from the waiting passenger number detector for the landing of a given floor, say, the waiting-passenger number detector HP2U for the 2nd floor to the circuit of FIG. 26. As already explained, the waiting-passenger number detector is comprised of mat switches, and the output signal therefrom is applied in the form of signals H2UA to H2UC to the passenger number forecasting circuit for the respective floors in the serviceability decision circuit of FIG. 26 through the appropriate contacts of the service relays Ry2UA to Ry2UC (up travel at the second floor) determined by the circuit of FIG. 23.

The serviceability decision circuit of FIG. 26 includes a circuit for forecasting the number of in-cage passengers at the time of arrival of car A at a leading floor and a circuit for deciding whether or not the forecast number of in-cage passengers exceed a predetermined number. The drawing under consideration concerns only car A for up travel.

First, the total current number of in-cage passengers $V_{CPD}$ is applied to the adder AD1UA through the contact UP*a*4 energized during the up travel of car A. This adder AD1UA is also impressed with the signal H1UA representing the number of passengers waiting at the 1st floor, so that the sum of the two inputs is applied to the adder AD2UA. In this case, the signal H1UA representing the number of prospective passengers waiting at the 1st floor is not generated unless it is decided that car A serve an up hall call from the 1st floor, as will be understood from the description with reference to FIG. 25. As a result, in the absence of a basement, it will be safe to conclude that the signal H1UA is produced, only when car A is staying at the 1st floor, an up hall call from the 1st floor is issued and car A has responded to that particular hall call. For this reason, the output $V_{CPD}$ of the in-cage passenger number detector will probably be zero. In other words, the output of the adder AD1UA indicates the number of passengers in car A at the time of starting from the 1st floor with the generation of the signal H1UA representing the number of hall waiting passengers at the 1st floor who are going to get on car A. Of course, unless there is no uphhall call generated at the 1st floor, or unless an up hall call is generated at the 1st floor but not served by car A, then the signal H1UA is not produced, so that the output of the adder AD1UA, that is, the signal representing the number of in-cage passengers at the time of starting of car A from the 1st floor is in the state of "0".

The adder AD2UA in the subsequent stage is for calculating the number of in-cage passengers of car A at the time of starting thereof from the 2nd floor. For the purpose of such a calculation, it is necessary to subtract from the number of in-cage passengers before the arrival of car A at the 2nd floor, that is, from the output of adder AD1UA, the number of passengers getting off at the 2nd floor, and at the same time to add to the output of adder AD1UA the number of passengers getting on at the 2nd floor.

The number of passengers getting off at the 2nd floor can be calculated, as explained with reference to FIG. 24 and the preceding embodiment, on the basis of the numbers of passengers for destination floors. The signal P2UA indicating the number of passengers going to the 2nd floor is applied in negative form to the adder AD2UA and subtracted from the already-registered number of passengers. Also, the number of passengers expected to get on the car at the 2nd floor is detected by the hall waiting passenger number detector HP2U in FIG. 25, so that when an up hall call is generated from the 2nd floor and it is decided that car A serve that hall call, the signal H2UA representing the number of passengers expected to get on at the 2nd floor is produced. This signal is added to the other input at the adder AD2UA, the output of which is a signal forecasting the number of in-cage passengers for car A at the time of starting thereof from the 2nd floor. In this way, the number of passengers in the car at each floor is forecast.

The adding and subtracting operation is effected in such a manner that the forecast number of passengers who get off at a floor for which a cage call is registered is subtracted only at the particular floor by the operation of the control panel in the car, while on the other hand the number of prospective passengers waiting at a floor generating a hall call which, it has been decided, car A serve is added only at that floor.

Thus it is possible to forecast the number of passengers in the car at the time of starting from whichever floor the car is located. When the car changes its direction of travel, it will be obvious that quite a similar circuit configuration can be realized by introducing the passenger number signal $V_{CPD}$ by the use of the signal DN*a*4 for the down travel.

Next, the comparators CM2UA to CM9UA connected to the adder group mentioned above are for comparing the setting *vo* of in-cage passenger number with the forecast in-cage passenger number, and producing output signals AM2U to AM9U respectively when the forecast value exceeds the setting *vo*.

Even if a car is selected which is most suitable for serving a hall call in accordance with its provisional service zone, such a selection is useless in the case where the prospective passengers cannot get on the car due to the car being filled to the capacity. Also, there may be a case in which it is not recommended under the prevailing group control condition that a certain car is loaded with more than a certain number of passengers. It is according to such a changing condition that the number limit of passengers common to all the cars or applicable to individual cars is determined. The signals AM2U to AM9U thus obtained are used for preventing a specified car or cars from serving a specified floor or floors after deciding that it is unsuitable for the car or cars to serve such a floor or floors.

The explanation will be continued by turning back to FIG. 19, FIG. 22 and FIG. 23.

The description has already been made up to a point where the provisional service zones are set. The service zone signals are not transmitted any farther than the inhibit elements IN1UA3 to IN9UA3 and IN2DA3 to IN10DA3 as they are obstructed thereby in the event that an appropriate prohibit signal among the prohibit signals AM is generated at the time of generation of the service zone signals. In the absence of any appropriate prohibit signal generated, by contrast, the service zone signals are applied through L1UA to L9UA and L2DA to L10DA to the OR elements 01UA8 to 09UA8 and 02DA8 to 010DA8, and thus take the form of service zone signals LL1UA to LL9UA and LL2DA to LL10DA through the interlocking inhibit elements for preventing the setting of overlapped service zones for different cars.

These signals are applied to the circuit of FIG. 23 and through the memory elements R1UA to R9UA and R2DA to R10DA, operate in such a manner as to energize the service relays R*y*1UA to R*y*9UA and R*y*2DA to R*y*10DA upon the generation of hall calls HC1U to 9U and HC2D to 10D. These memory elements are so constructed as to store and maintain any energized state of the service relays, and upon completion of the intended service or arrival at the intended floor in answer to an appropriate hall call, release themselves from the stored state.

A somewhat different type of service is possible by changing the construction of the memory elements. In other words, it is possible to reset the memory elements through an AND element impressed with a signal indicating the generation of a prohibit signal as obtained from the circuit of FIG. 26 and with a signal indicating the presence of a service zone signal as obtained from the circuit of FIG. 19. In this case, a car with little room for accomodating additional passengers is controlled not to respond to a hall call involving a great number of prospective passengers, as will be described more in detail later.

In this way, the service relays R*y*1UA to R*y*9UA and R*y*2DA to R*y*10DA are energized only in response to a hall call which does not accompany any inserviceability signals AM associated with the floors included in the provisional service zone of the car concerned. A car is thus specified to serve the hall call.

Referring to the embodiments of FIG. 1 and FIG. 2 in this connection, the calculation shown to the extreme right side (7) of FIG. 1 is effected by the adders AD1UA to AD9UA in FIG. 26. In the case where the load limit setting vo is a voltage corresponding to, say, 10 persons, the comparators CM7UA and CM8UA corresponding to the 7th and 8th floors produce outputs. As a result, the inserviceability signals AM7U and AM8U are produced thereby to prohibit the generation of the signals L7UA and L8UA in FIG. 19. At the next instant, the signal LL7UA that has thus far been present disappears. However, it is ineffective since as mentioned earlier the energized state of the relay Ry7US is stored in the memory element R7UA, with the result that car A is still ready to serve the up hall call from the 7th floor which has already been generated. In view of the fact that L8UA is prohibited, however, the up hall call HC8U for the 8th floor which might be generated cannot served by car A any more.

For this reason, the service zone of car A, as shown in FIG. 2, comprises the upward direction for the 2nd to 7th floors and upward direction for the 9th floor.

Now, if, as already assumed, the memory element R7UA is cleared through an AND element impressed with a signal indicating the generation of the prohibit signal AM7U and a signal indicating the disapperance of the service zone signal L7UA, the relay Ry7UA is also de-energized in the above-mentioned case. In other words, up to 9 persons are allowed in the car, whereas a hall call involving 10 or more persons, if generated, is provisionally allotted but decided to be inserviceable as it exceeds the room available in the car.

The operation for allotting the hall call thus determined inserviceable to the succeeding car will be explained in detail below with reference to FIG. 22.

In the explanation of the circuit of FIG. 19, reference was made to the case in which the provisional service zone is from 2U to 9U for car A, from 10D to 6D for car B and from 5D to 2D and 1U for car C. Under this condition, the explanation will be made below of the fact that the secondary provisional service zone is from 10D to 6D for car A, from 5D to 2D and 1U for car B and from 2U to 9U for car C.

The fact that car B is travelling down at the 10th floor in the case of FIG. 19 causes the signal 10D to be generated in the circuit of car B and transmitted to the circuit for car A (FIG. 19). Also, since the signal S10DA for the down travel from the 10th floor is generated in FIG. 19, the AND element A10DA4 in the circuit of FIG. 22 produces a "1" signal, which is applied through other elements as in the case of FIG. 19. In like manner, signals are generated by the circuits for cars B and C (which are not shown) which are travelling down at the 5th floor and up at the 2nd floor respectively. As a result, the secondary provisional service zone is determined to be from 10D to 6D for car A, from 5D to 2D for car B and from 2U to 9U for car C. In other words, the secondary provisional service zone of a given car coincides with the primary provisional service zone of an immediately leading car.

The signals representing these primary and secondary provisional service zones are applied to the OR elements 01UA8 to 09UA8 and 02DA8 to 010DA8 and take the form of the signals LL1UA to LL9UA and LL2DA to LL10DA through the inhibit elements, which are adapted to be prohibited according to the conditions mentioned below.

These signals, as already explained, operate in such a manner as to energize the call-allotting relays Ry1UA to Ry9UA and Ry2DA to Ry10DA through the circuit of FIG. 23. The prohibit signals LL1UA to LL9UA and LL2DA to LL10DA produced from the inhibit elements are signals produced as the result of deciding a service car in response to a hall call, as will be seen from FIG. 20, on the basis of the primary provisional service zone signals of another car involving the floor concerned. In this way, the hall call which has not been allotted to any car as yet can be allotted to a succeeding car.

It is desirable to indicate as early as possible the car thus allotted to the hall call on the landing of the service floor and to guide prospective passengers toward it, leading to an improved service to the prospective passengers waiting for a car on the landing. In addition, this facilitates the detection of the number of prospective passengers expected to get on the car, resulting in an improved accuracy of detection and forecasting.

According to the elevator control apparatus of the present invention, elevator cars are controlled by deciding the range of response to hall calls on the basis of the number of prospective passengers waiting on the floors and the numbers of passengers for destination floors, thus making it possible to improve the elevator car group control system. The apparatus according to the invention is especially advantageous in that the waiting time which otherwise might be long due to the filled-up state of cars during the lunch recess, evening and morning rush hours is shortened and in that indications on the device, if any, for indicating a car ready to serve a hall call are altered less often.

Further, the situation is avoided where the car that has responded to a hall call and stopped at the floor concerned leaves unloaded any of the calling persons at the floor, resulting in an improved car service and operating efficiency.

Furthermore, instead of the analog circuits which are employed in the above description of the elevator control apparatus to facilitate the understanding of the invention may of course be replaced by digital circuits without departing from the spirit of the present invention.

A schematic block diagram showing the case where the operation of forecasting the number of passengers in the car as effected in the circuits of FIG. 24 to FIG. 26 is processed digitally is shown in FIG. 27.

Signals including the number of in-cage passenger signal CPD and the number of hall waiting passenger signal HP are converted into digital signals by the A-D converter and applied to the processor P. The processor P, which may alternatively take the form of a single-purpose processing unit, is considered to consist of a multi-purpose control computer in the present case. It will be needless to say that such a control computer easily performs the operation as described in the circuits of FIG. 24 and FIG. 26.

By the way, reference symbol S shows the other various signals, symbol Me a memory and OutPut the output of the memory Me.

It will thus be seen that the objects set forth above, among those made apparent from the preceding description, are efficiently attained, and since certain changes may be made in the above constructions without departing from the spirit and scope of the invention, it is intended that all matter contained in the above description or shown in the accompanying drawings shall be interpreted as illustrative and not in a limiting sense.

What is claimed is:

1. An elevator control apparatus whereby a plurality of elevator cars serve a plurality of floors in accordance with the hall calls and cage calls registered in hall call registration means provided on the respective floors and cage call registration means provided in said cars, respectively; said apparatus comprising means for detecting the numbers of passengers in each of said cars for destination floors; said number-of-passengers-for-destination-floor detector means including means for detecting the number of passengers in said car, means for setting the ratio at which the number of passengers in said car is allotted to the floors associated with said registered cage calls, and means for allotting the number of passengers in said car to the floors associated with the cage calls at the set allotment ratio.

2. An elevator control apparatus according to claim 1, in which said means for detecting the numbers of passengers in the car for destination floors include means for storing in memory said allotted numbers of passengers for destination floors and means for correcting the information stored in said memory means in accordance with changes in said number of passengers in the cars or changes in said cage calls.

3. An elevator control apparatus according to claim 2, further comprising means for detecting the number of passengers who have additionally got on each of the cars at service floors, means for detecting cage calls additionally registered by said passengers, means for allotting said additional passengers to said additional cage calls, means for storing in memory the numbers of said allotted passengers for destination floors, and means for correcting the information stored in said memory means in accordance with a signal representing said numbers of passengers for destination floors, said signal being produced at the respective service floors.

4. An elevator control apparatus according to claim 3, in which said means for detecting the number of passengers who have additionally got on each of the cars include first detector means for detecting the number of passengers in said each of the cars, said number being the result of subtracting the number of passengers allotted to a given service floor from the number of passengers in said each of the cars prior to the stoppage of said each of the cars at said service floor, second detector means for detecting the number of passengers in said each of the cars after passengers have got on and off the cars at said service floor, and means for subtracting the output of said first detector means from the output of said second detector means.

5. An elevator control apparatus according to claim 3, further comprising means for detecting the numbers of prospective passengers waiting at the respective floors, said number of additional passengers being detected by said waiting-prospective-passenger detector means provided at the floor where said additional passengers got on the cars.

6. An elevator control apparatus according to claim 3, further comprising means for detecting the cage calls registered already before the stoppage of each of the cars at the floors associated with said cage calls, means for allotting to said registered cage calls an excess, if any, of said number of additional passengers over a predetermined value, and means for adding said allotted numbers of passengers for destination floors to said already registered number of passengers.

7. An elevator control apparatus according to claim 6, in which the means for determining said predetermined value includes means for detecting the number of cage calls newly registered and means for adjusting said predetermined value in accordance with said newly registered number of cage calls.

8. An elevator control apparatus according to claim 1, in which said means for detecting the numbers of passenger for destination floors include means for detecting the difference between the number of passengers getting off at each service floor and the number of passengers for destination floor for said service floor, and means for correcting said registered numbers of passengers for destination floors in accordance with the output of said difference-detector means.

9. An elevator control apparatus according to claim 1, in which said means for detecting the numbers of passengers for destination floors include means for adding all of said detected numbers of passengers for destination floors and means for correcting said numbers of passengers for destination floors in such a manner that the sum of said numbers of passengers for destination floors coincides with the total number of passengers in the car.

10. An elevator control apparatus according to claim 1, in which said means for detecting the numbers of passengers for destination floors include means for preventing the passengers in the cars from being allotted to the cage calls for the floors which the cars have already passed.

11. An elevator control apparatus according to claim 1, in which said means for setting the allotment ratio include means capable of adjusting said allotment ratio as desired.

12. An elevator control apparatus according to claim 11, further comprising means for detecting the elevator car traffic demand and means for adjusting said allotment-ratio adjusting means in accordance with said detected elevator car traffic demand.

13. An elevator control apparatus according to claim 1, comprising a plurality of elevator cars in juxtaposition, means for detecting the numbers of prospective passengers waiting at the respective floors, means for allotting registered hall calls to said cars, and means for forecasting the number of passengers in the car, said forecasting means being provided for the respective cars; said number-of-passenger forecasting means including means for adding to and subtracting from said detected number of passengers said number of prospective passengers waiting at said allotted floors associated with said hall calls and said detected numbers of passengers for destination floors, respectively.

14. An elevator control apparatus according to claim 13, further comprising means for setting a number limit of passengers of the respective cars and means for deciding the floors at which the respective cars are able to serve, said deciding means being provided for the respective cars; said serviceable-floor-deciding means including means for comparing said forecast number of passengers with said set number limit of passengers.

15. An elevator control apparatus according to claim 14, in which said hall call allotting means include means for preventing the registered hall calls from being allotted to the car that has decided not to be able to serve the floors associated with said registered hall calls.

16. An elevator control apparatus according to claim 14, in which said hall call allotting means include means for detecting the car positions, means for setting a provisional service zone for each car from the relation between said cars in response to the output of said car-position detector means, said each car taking charge of hall calls included in said provisional service zone, means for determining as the service zone of each car the floors which are included in said provisional service zone and which, it is decide decided, are capable of being served by said each car, and means for allotting a registered hall call to said car the provisional service zone of which includes the floor associated with said registered hall call.

17. An elevator control apparatus according to claim 16, in which said hall call allotting means include means for determining the provisional service zone of said each car to be the secondary provisional zone of a car running immediately behind said each car and means for allotting the registered hall calls not included in the service zones of any of said cars, to the car which has the secondary provisional service zone including said hall calls and which, it is decided, is able to serve said registered hall calls.

* * * * *